US009808065B2

(12) United States Patent
Moloney et al.

(10) Patent No.: US 9,808,065 B2
(45) **Date of Patent: *Nov. 7, 2017**

(54) HAND HELD APPLIANCE

(71) Applicant: Dyson Technology Limited, Wiltshire (GB)

(72) Inventors: Patrick Joseph William Moloney, Swindon (GB); Edward Sebert Maurice Shelton, Swindon (GB); Stephen Benjamin Courtney, Bath (GB); Peter David Gammack, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 25 days.

This patent is subject to a terminal disclaimer.

(21) Appl. No.: 14/903,023

(22) PCT Filed: Jun. 13, 2014

(86) PCT No.: PCT/GB2014/051829

§ 371 (c)(1),
(2) Date: Jan. 5, 2016

(87) PCT Pub. No.: WO2015/001305

PCT Pub. Date: Jan. 8, 2015

(65) Prior Publication Data

US 2016/0143409 A1 May 26, 2016

(30) Foreign Application Priority Data

Jul. 5, 2013 (GB) ..... 1312067.0

(51) Int. Cl.
*A45D 20/10* (2006.01)
*A45D 20/08* (2006.01)
(Continued)

(52) U.S. Cl.
CPC ..... *A45D 20/10* (2013.01); *A45D 20/08* (2013.01); *A45D 20/12* (2013.01); *A45D 20/50* (2013.01)

(58) Field of Classification Search
CPC ..... A45D 20/00; A45D 20/10; A45D 20/12; A45D 20/50
(Continued)

(56) References Cited

U.S. PATENT DOCUMENTS 1,564,896 A 12/1925 Rinker et al.
2,088,189 A 7/1937 Ducart
(Continued)

FOREIGN PATENT DOCUMENTS

CH 588 835 6/1977
CN 200973446 11/2007
(Continued)

OTHER PUBLICATIONS

Moloney et al., U.S. Office Action dated Nov. 3, 2016, directed to U.S. Appl. No. 14/323,864; 10 pages.
(Continued)

*Primary Examiner* — Stephen M Gravini
(74) *Attorney, Agent, or Firm* — Morrison & Foerster LLP

(57) ABSTRACT

A hair care appliance including a body, and a handle having a first end in fluid communication with the body and a second end comprising a primary fluid inlet into the appliance wherein the primary fluid inlet includes a first aperture extending at least partially around the handle and a second aperture extending through the second end of the handle. The handle can include an end wall that is substantially orthogonal to the handle at the second end with the second aperture extending through the end wall. The first aperture may be adjacent the second end. The handle may include a
(Continued)

fan unit for drawing fluid into the primary fluid inlet upstream of the primary fluid inlet. The first aperture may include a plurality of apertures extending at least partially around and along the handle. The second aperture may include a plurality of apertures extending through the handle end.

31 Claims, 18 Drawing Sheets

(51) Int. Cl.
*A45D 20/12* (2006.01)
*A45D 20/50* (2006.01)

(58) Field of Classification Search
USPC ..... 34/97–99
See application file for complete search history.

(56) References Cited

U.S. PATENT DOCUMENTS 2,432,067 A 12/1947 Morse
3,265,075 A 8/1966 Edman et al.
4,197,448 A 4/1980 Harigai
4,232,454 A 11/1980 Springer
4,250,902 A 2/1981 Ihara
4,350,872 A 9/1982 Meywald et al.
4,409,998 A 10/1983 Bauer
4,506,454 A 3/1985 Kerschgens
4,596,921 A 6/1986 Hersh et al.
4,635,382 A 1/1987 Bourdeau
4,767,914 A 8/1988 Glucksman
4,800,654 A 1/1989 Levin et al.
4,903,416 A 2/1990 Levin et al.
4,990,948 A 2/1991 Sasaki et al.
5,121,463 A 6/1992 Yoshihara
5,133,043 A 7/1992 Baugh
5,155,925 A 10/1992 Choi
D350,413 S 9/1994 Feil
D352,365 S 11/1994 Hansen et al.
5,378,882 A 1/1995 Gong et al.
5,444,215 A 8/1995 Bauer
5,546,674 A 8/1996 Lange et al.
5,555,637 A 9/1996 Montagnino
5,572,800 A 11/1996 West
5,598,640 A 2/1997 Schepisi
5,681,630 A 10/1997 Smick et al.
5,784,800 A 7/1998 Santhouse et al.
5,857,262 A 1/1999 Bonnema et al.
5,875,562 A 3/1999 Fogarty
5,954,064 A 9/1999 Motherhead
5,956,863 A 9/1999 Allen
5,996,243 A 12/1999 Chang et al.
6,148,537 A 11/2000 Altamore
6,203,349 B1 3/2001 Nakazawa
6,367,162 B2 4/2002 Fukumoto et al.
6,591,516 B2 7/2003 Kamada et al.
6,751,886 B2 6/2004 Chang et al.
6,792,692 B1 9/2004 Takizawa et al.
6,889,445 B1 5/2005 Varona et al.
6,986,212 B2 1/2006 Saida et al.
7,047,660 B2 5/2006 Leventhal
D550,813 S 9/2007 Lammel et al.
7,412,781 B2 8/2008 Mattinger et al.
7,753,079 B2 7/2010 Nelson
7,913,416 B1 3/2011 Scieri
D646,354 S 10/2011 Gessi
8,132,571 B1 3/2012 Jackson
D682,472 S 5/2013 Dyson et al.
8,496,028 B2 7/2013 Nelson et al.
D696,386 S 12/2013 Schoenherr et al.
D702,322 S 4/2014 Sieger
8,782,920 B2 7/2014 Marthinsen et al.
D716,492 S 10/2014 Dyson et al.
8,893,400 B2 11/2014 Carme
8,922,082 B2 12/2014 Kwon
9,144,286 B2 9/2015 Courtney et al.
9,173,468 B2 11/2015 Moloney et al.
9,241,556 B2 * 1/2016 Lee ..... A45D 20/12
9,414,662 B2 * 8/2016 Moloney ..... A45D 20/10
9,420,864 B2 * 8/2016 Gammack ..... A45D 20/08
9,420,865 B2 * 8/2016 Gammack ..... A45D 20/08
9,510,395 B2 11/2016 Coulton et al.
9,512,959 B2 12/2016 Atkinson
9,596,916 B2 * 3/2017 Moloney ..... A45D 20/12
2001/0005943 A1 7/2001 Fukumoto et al.
2003/0041471 A1 * 3/2003 Shaw, II ..... A45D 20/12 34/96
2004/0163274 A1 8/2004 Andrew et al.
2004/0172847 A1 9/2004 Saida et al.
2005/0052018 A1 3/2005 Pichotta
2005/0229422 A1 10/2005 Mattinger et al.
2006/0075654 A1 4/2006 Lin
2007/0294909 A1 12/2007 Abdi et al.
2010/0064542 A1 3/2010 Mulvaney et al.
2010/0065545 A1 3/2010 Chung et al.
2010/0162585 A1 7/2010 Liu et al.
2010/0170588 A1 7/2010 Nelson
2011/0079239 A1 4/2011 Hall
2011/0177711 A1 7/2011 Park
2011/0197466 A1 8/2011 Shami et al.
2011/0203128 A1 8/2011 Rodrigues
2011/0219636 A1 9/2011 Rowling
2013/0045084 A1 2/2013 Tu et al.
2013/0111777 A1 5/2013 Jeong
2013/0269200 A1 10/2013 Moloney et al.
2013/0269201 A1 10/2013 Courtney et al.
2013/0276320 A1 10/2013 Courtney et al.
2013/0276321 A1 10/2013 Courtney et al.
2013/0283630 A1 10/2013 Courtney et al.
2013/0283631 A1 10/2013 Moloney et al.
2013/0326898 A1 12/2013 Quessard et al.
2014/0007448 A1 1/2014 Courtney et al.
2014/0007449 A1 1/2014 Courtney et al.
2014/0007450 A1 1/2014 Yao
2014/0191603 A1 7/2014 Lim
2015/0007442 A1 1/2015 Gammack et al.
2015/0007443 A1 1/2015 Gammack et al.
2015/0007444 A1 1/2015 Moloney et al.
2015/0007854 A1 1/2015 Moloney et al.
2015/0007855 A1 1/2015 Moloney et al.
2015/0026993 A1 * 1/2015 Sutter ..... A45D 20/10 34/96
2015/0089828 A1 4/2015 Moloney et al.
2015/0093099 A1 4/2015 Shelton et al.
2016/0143409 A1 * 5/2016 Moloney ..... A45D 20/08 34/97
2016/0206075 A1 * 7/2016 Stephens ..... A45D 20/12
2016/0206076 A1 * 7/2016 Stephens ..... A45D 20/10
2016/0206077 A1 * 7/2016 Stephens ..... A45D 20/12
2016/0220004 A1 8/2016 Moloney et al.
2016/0255935 A1 9/2016 Li et al.
2016/0309874 A1 10/2016 Hedges
2017/0079401 A1 * 3/2017 Courtney ..... A45D 20/12

FOREIGN PATENT DOCUMENTS

CN 100353882 12/2007
CN 201328477 10/2009
CN 201341553 11/2009
CN 101292806 10/2010
CN 201774080 3/2011
CN 201948229 8/2011
CN 202146022 2/2012
CN 202386031 8/2012
CN 202536440 11/2012
CN 202774786 3/2013
DE 25 59 697 7/1977
DE 26 18 819 11/1977
DE 31 01 933 9/1982
DE 43 32 300 12/1994
DE 195 27 111 1/1997
DE 10 2009 049 838 4/2011

(56) References Cited

FOREIGN PATENT DOCUMENTS

| | | | | |
|---|---|---|---|---|
| EP | 0 105 810 | | 4/1984 | |
| EP | 0 300 281 | | 1/1989 | |
| EP | 0 306 765 | | 3/1989 | |
| EP | 0 400 381 | | 12/1990 | |
| EP | 0 970 633 | | 1/2000 | |
| EP | 1 433 401 | | 8/2004 | |
| EP | 1 616 500 | | 1/2006 | |
| EP | 1 661 481 | | 5/2006 | |
| EP | 2 000 042 | | 12/2008 | |
| EP | 2 255 692 | | 12/2010 | |
| EP | 2 392 223 | | 12/2011 | |
| EP | 2 401 939 | | 1/2012 | |
| EP | 3 016 543 | | 5/2016 | |
| FR | 1.387.334 | | 12/1964 | |
| FR | 1.408.096 | | 6/1965 | |
| FR | 2 906 980 | | 4/2008 | |
| FR | 2 907 642 | | 5/2008 | |
| GB | 647291 | | 12/1950 | |
| GB | 953057 | | 3/1964 | |
| GB | 972682 | | 10/1964 | |
| GB | 1 417 052 | | 12/1975 | |
| GB | 1 446 385 | | 8/1976 | |
| GB | 1 456 000 | | 11/1976 | |
| GB | 1 489 723 | | 10/1977 | |
| GB | 1 539 485 | | 1/1979 | |
| GB | 2 295 056 | | 5/1996 | |
| GB | 2 316 868 | | 3/1998 | |
| GB | 2 431 136 | | 4/2007 | |
| GB | 2464736 | | 4/2010 | |
| GB | 2472240 | | 2/2011 | |
| GB | 2478927 | | 9/2011 | |
| GB | 2482547 | | 2/2012 | |
| GB | 2482548 | | 2/2012 | |
| GB | 2482549 | | 2/2012 | |
| GB | 2500798 | | 10/2013 | |
| GB | 2500800 | | 10/2013 | |
| GB | 2503684 | | 1/2014 | |
| GB | 2503685 | | 1/2014 | |
| GB | 2503686 | | 1/2014 | |
| GB | 2515811 | | 1/2015 | |
| GB | 2531431 | A * | 4/2016 | ..... A45D 20/10 |
| JP | 41-22432 | | 11/1966 | |
| JP | 42-17299 | | 10/1967 | |
| JP | 48-13744 | | 4/1973 | |
| JP | 52-29579 | | 3/1977 | |
| JP | 53-131879 | | 10/1978 | |
| JP | 54-79885 | | 6/1979 | |
| JP | 54-110382 | | 8/1979 | |
| JP | 55-113408 | | 9/1980 | |
| JP | 55-151908 | | 11/1980 | |
| JP | 56-54003 | | 5/1981 | |
| JP | 58-32706 | | 3/1983 | |
| JP | 59-228806 | | 12/1984 | |
| JP | 60-135700 | | 7/1985 | |
| JP | 60-193408 | | 10/1985 | |
| JP | 61-98206 | | 5/1986 | |
| JP | 61-86102 | | 6/1986 | |
| JP | 62-249606 | | 10/1987 | |
| JP | 62-192308 | | 12/1987 | |
| JP | 63-238807 | | 10/1988 | |
| JP | 64-27506 | | 1/1989 | |
| JP | 64-29208 | | 1/1989 | |
| JP | 4-221507 | | 8/1992 | |
| JP | 5-7507 | | 1/1993 | |
| JP | 5-130915 | | 5/1993 | |
| JP | 7-16113 | | 1/1995 | |
| JP | 7-155219 | | 6/1995 | |
| JP | 3014299 | | 8/1995 | |
| JP | 8-343 | | 1/1996 | |
| JP | 9-10185 | | 1/1997 | |
| JP | 2573211 | | 1/1997 | |
| JP | 2000-201723 | | 7/2000 | |
| JP | 2001-37530 | | 2/2001 | |
| JP | 2002-119325 | | 4/2002 | |
| JP | 2002-238649 | | 8/2002 | |
| JP | 2003-153731 | | 5/2003 | |
| JP | 2004-312 | | 1/2004 | |
| JP | 2004-113402 | | 4/2004 | |
| JP | 2004-208935 | | 7/2004 | |
| JP | 2004-293389 | | 10/2004 | |
| JP | 2004-357763 | | 12/2004 | |
| JP | 2005-546 | | 1/2005 | |
| JP | 2005-508524 | | 3/2005 | |
| JP | 2005-532131 | | 10/2005 | |
| JP | 2006-51181 | | 2/2006 | |
| JP | 2006-130181 | | 5/2006 | |
| JP | 2006-181265 | | 7/2006 | |
| JP | 2007-136121 | | 6/2007 | |
| JP | 2008-231249 | | 10/2008 | |
| JP | 2010-274050 | | 12/2010 | |
| JP | 2012-45178 | | 3/2012 | |
| JP | 6052517 | | 12/2016 | |
| KR | 2003-0074490 | | 9/2003 | |
| KR | 10-1229109 | | 2/2013 | |
| NL | 2001375 | | 9/2009 | |
| WO | WO-83/02753 | | 8/1983 | |
| WO | WO-94/23611 | | 10/1994 | |
| WO | WO-03/040809 | | 5/2003 | |
| WO | WO-2004/006712 | | 1/2004 | |
| WO | WO-2005/120283 | | 12/2005 | |
| WO | WO-2007/043732 | | 4/2007 | |
| WO | WO-2008/053099 | | 5/2008 | |
| WO | WO-2012/059700 | | 5/2012 | |
| WO | WO-2012/069983 | | 5/2012 | |
| WO | WO-2012/076885 | | 6/2012 | |
| WO | WO-2015/001307 | | 1/2015 | |
| WO | WO-2015/087040 | | 6/2015 | |

OTHER PUBLICATIONS

Search Report dated Nov. 28, 2013, directed to GB Application No. 1312067.0; 1 page.

International Search Report and Written Opinion dated Nov. 13, 2014, directed to International Application No. PCT/GB2014/051829; 15 pages.

Courtney et al., Office Action dated Sep. 24, 2014, directed to U.S. Appl. No. 13/853,739; 12 pages.

Moloney et al., Office Action dated Nov. 14, 2014, directed to U.S. Appl. No. 13/853,835; 7 pages.

Moloney et al. , Office Action dated Jul. 15, 2015, directed to U.S. Appl. No. 14/323,864; 9 pages.

Moloney et al., Office Action dated Jul. 2, 2015, directed to U.S. Appl. No. 14/323,785; 11 pages.

Moloney et al., U.S. Office Action dated Jan. 15, 2016, directed to U.S. Appl. No. 14/323,785; 13 pages.

Moloney et al., U.S. Office Action dated Feb. 2, 2016, directed to U.S. Appl. No. 14/323,937; 12 pages.

Gammack et al., U.S. Office Action dated Feb. 8, 2016, directed to U.S. Appl. No. 14/323,848; 11 pages.

Gammack et al., U.S. Office Action dated Feb. 9, 2016, directed to U.S. Appl. No. 14/323,739; 10 pages.

Moloney et al., U.S. Office Action dated Feb. 25, 2016, directed to U.S. Appl. No. 14/323,864; 9 pages.

Moloney et al., U.S. Office Action dated Jun. 17, 2016, directed to U.S. Appl. No. 14/323,785; 7 pages.

Moloney et al., U.S. Office Action dated Jul. 7, 2016, directed to U.S. Appl. No. 14/323,864; 9 pages.

Reba, I. (1966). "Applications of the Coanda Effect," Scientific American 214:84-92.

Moloney et al., U.S. Office Action dated Apr. 3, 2017, directed to U.S. Appl. No. 14/903,047; 13 pages.

* cited by examiner

HAND HELD APPLIANCE

REFERENCE TO RELATED APPLICATIONS

This application is a national stage application under 35 USC 371 of International Application No. PCT/GB2014/051829, filed Jun. 13, 2014, which claims the priority of United Kingdom Application No. 1312067.0, filed Jul. 5, 2013, the entire contents of which are incorporated herein by reference.

FIELD OF THE INVENTION

This invention relates to a hand held appliance, in particular a hair care appliance and an appliance, such as a hairdryer or a hot styling brush.

BACKGROUND OF THE INVENTION

Blowers and in particular hot air blowers are used for a variety of applications such as drying substances such as paint or hair and cleaning or stripping surface layers. In addition, hot air blowers such as hot styling brushes are used to style hair from a wet or dry condition.

Generally, a motor and fan are provided which draw fluid into a body; the fluid may be heated prior to exiting the body. The motor is susceptible to damage from foreign objects such as dirt or hair so conventionally a filter is provided at the fluid intake end of the blower. Conventionally such appliances are provided with a nozzle which can be attached and detached from the appliance and changes the shape and velocity of fluid flow that exits the appliance. Such nozzles can be used to focus the outflow of the appliance or to diffuse the outflow depending on the requirements of the user at that time.

SUMMARY OF THE INVENTION

According to a first aspect, the invention provides a hair care appliance comprising a body comprising an outer wall, and a handle comprising an outer wall and a wall disposed within the outer wall wherein, the outer wall of the body and the wall of the handle are formed as a single unit.

Forming the body and the wall of the handle as a single unit has a number of advantages. Firstly the access to at least some of the components of the appliance is made more difficult. In convention hairdryers, a clam shell construction is used and the two parts are usually screwed together. A user can relatively easily remove the screws and access the heater and fan unit. In the present invention, as there are no joins or screws that can be removed, it is made more difficult for a user to take the product apart. Secondly, the product is visually cleaner. There are no join lines running along the length of the body and no recesses or extensions in the body that would be required in order to connect the two parts.

Preferably, the wall comprises an access aperture extending at least partially along and around the wall.

It is preferred that the wall comprises a hatch for closing the access aperture.

Preferably, the handle comprises a primary fluid inlet disposed at and/or near the distal end of the handle from the body. Preferably, the primary fluid inlet extends at least partially around and along the handle. Preferably, the primary fluid inlet comprises at least one aperture extending around the outer wall. It is preferred that the primary fluid inlet comprises at least one aperture extending along the outer wall. Preferably, the primary fluid inlet comprises at least one aperture extending across the outer wall.

Preferably, the handle comprises a primary fluid flow path flowing from the primary fluid inlet along the handle and into the body. It is preferred that the primary fluid flow path flows from the primary fluid inlet within the wall to the body.

Preferably, the handle comprises a fan unit wherein the fan unit draws fluid into the primary fluid flow path.

It is preferred that the body comprises a primary fluid outlet for the primary fluid flow path. Preferably, the primary fluid outlet is in fluid communication with the primary fluid inlet and the primary fluid flow path.

Preferably, the body comprises a first end and a second end and the primary fluid outlet is at the second end.

Preferably, the body comprises a fluid flow path. Preferably, the fluid flow path extends from a fluid inlet in the body to a fluid outlet.

It is preferred that the body comprises a duct extending within the outer wall of the body and the duct extends from the first end.

Preferably, the primary fluid flow path extends between the outer wall of the body and the duct. Preferably, the primary fluid flow path extends to a primary fluid outlet. Preferably, the primary fluid flow path extends about the duct. Preferably, the primary fluid flow path extends at least partially along the duct. Preferably, the duct extends at least partially along the body.

It is preferred that the duct defines a fluid flow path extending through the body. Preferably, the fluid flow path extends from a fluid inlet to a fluid outlet. Preferably, the fluid flow path extends within the duct. Preferably, the fluid flow path extends from a fluid inlet in the body through the duct to a fluid outlet from the body.

Preferably, the duct extends about the fluid flow path. Preferably, the fluid flow path extends through the duct. Preferably, the fluid flow path is defined by a duct extending through the body. Preferably, the fluid flow path exits the body by the fluid outlet. Preferably, the fluid flow path is provided through the duct.

According to another aspect, the invention provides a hair care appliance comprising a body, and a handle having a first end in fluid communication with the body and a second end comprising a primary fluid inlet into the appliance wherein the primary fluid inlet comprises a first aperture extending at least partially around the handle and a second aperture extending through the second end of the handle wherein the body comprises a fluid flow path and the fluid flow path is defined by a duct extending through the body.

It is preferred that the fluid inlet is at the first end of the body.

Preferably, the fluid flow path merges with the primary fluid flow path within the body.

Also disclosed in a hair care appliance comprising a body, and a handle having a first end in fluid communication with the body and a second end comprising a primary fluid inlet into the appliance wherein the primary fluid inlet comprises a first aperture extending at least partially around the handle and a second aperture extending through the second end of the handle wherein the body comprises a fluid flow path and wherein the primary fluid flow path merges with the fluid flow path within the body.

Alternatively, the primary fluid flow path surrounds the fluid flow path at the second end of the body. Fluid in the primary fluid flow path exits the body by the primary fluid outlet.

Preferably, the duct is connected to the outer wall of the body by a side wall extending between the duct and the outer wall. It is preferred that the side wall is angled to both the outer wall of the body and the duct. Preferably, the side wall is disposed at the first end of the body. It is preferred that the duct and side wall are formed as a single unit. Preferably, the duct and side wall are formed from a plastic material. It is preferred that the side wall at least partially defines the fluid inlet into the fluid flow path.

Preferably, the outer wall of the handle extends about the wall and partially along the wall. It is preferred that the outer wall of the handle extends over an access hatch into the wall.

Preferably, the outer wall of the handle extends about the wall for substantially the whole length of the wall. It is preferred that the wall of the handle comprises a primary fluid inlet. Preferably, the primary fluid inlet of the outer wall of the handle is in fluid communication with the primary fluid inlet of the wall of the handle.

According to another aspect, the invention provides a hair care appliance comprising a body, and a handle having a first end in fluid communication with the body and a second end comprising a primary fluid inlet into the appliance wherein the primary fluid inlet comprises a first aperture extending at least partially around the handle and a second aperture extending through the second end of the handle wherein the handle comprises a wall extending from the first end to the second end of the handle, comprises an outer wall wherein said outer wall extends around the wall and at least partially along the wall and the primary fluid flow path extends within the wall.

It is preferred that the outer wall of the body and wall of the handle are made from a plastic material.

Preferably, the outer wall of the handle is made from a different material to the wall of the handle and the outer wall of the body. Preferably, the outer wall is formed from a metal. Preferably, the outer wall of the handle is made from aluminium or an aluminium alloy.

It is preferred that the body comprises a heater. The heater is for heating fluid in the primary fluid flow path. Preferably, the heater is provided between the outer wall and the duct. It is preferred that the primary fluid flow path extends through the heater. Preferably, the heater extends along the body. It is preferred that the heater extends at least partially around the body. Alternatively, the heater extends around the body. It is preferred that the heater extends at least partially around and about the duct. Alternatively, the heater extends around about the duct. Preferably, the heater extends at least partially along the duct. Preferably, the heater is annular.

According to another aspect, the invention provides a hair care appliance comprising a body, and a handle having a first end in fluid communication with the body and a second end comprising a primary fluid inlet into the appliance wherein the primary fluid inlet comprises a first aperture extending at least partially around the handle and a second aperture extending through the second end of the handle wherein the body comprises a heater for heating fluid in the primary fluid flow path.

According to a second aspect, the invention provides a hair care appliance comprising a body having a duct, an outer wall extending about the duct and a side wall extending between the duct and the outer wall, wherein a control switch is provided on the side wall and wherein the outer wall, side wall and the duct are all external walls of the appliance.

Preferably, the body has an inlet end and an outlet end and the side wall is at the inlet end.

It is preferred that the duct at least partially defines a fluid flow path through the body.

Preferably, duct is recessed within the outer wall at the inlet end.

It is preferred that the handle is connected to the body at a first end. Preferably, a second control switch is provided on the handle. It is preferred that the second control switch is located on the handle adjacent to the inlet end of the body.

Preferably, both the first control switch and the second control switch are accessible by a single digit.

It is preferred that the second control switch comprises two buttons.

Preferably, the handle is generally tubular and at a distal end to the body the handle comprises a primary fluid inlet. It is preferred that the handle comprises a wall and at the distal end, the handle comprises an end wall extending across the wall. Preferably, the primary fluid inlet extends at least partially across the end wall.

It is preferred that the appliance comprises a power cable connectable to a power source at one end and extending into substantially the centre of the end wall of the handle at the other end.

Preferably, the handle comprises an outer wall and the outer wall extends at least partially along and around the wall.

Preferably, a lining material is provided between the outer wall and the wall. Preferably, the lining material is an insulating layer. Preferably, the lining material or insulating layer extends substantially continuously along and/or around the wall.

Preferably, the primary fluid outlet is at least partially defined by the duct. It is preferred that the primary fluid outlet is defined by the body and the duct.

Preferably, within the body, the primary fluid flow path and fluid flow path merge.

Preferably, the primary fluid outlet extends about the fluid flow path. Preferably, the body comprises a fluid outlet for the fluid flow path and the primary fluid outlet extends about the fluid outlet.

Preferably, the primary fluid outlet is at the outlet end of the body.

Preferably, the body decreases in diameter towards the outlet end.

Preferably, the first control switch comprises two buttons.

According to a third aspect, the invention provides a hair care appliance comprising a body, and a handle having a first end in fluid communication with the body and a second end comprising a primary fluid inlet into the appliance wherein the primary fluid inlet comprises a first aperture extending at least partially around the handle and a second aperture extending through the second end of the handle.

Having the primary fluid inlet disposed one more than one surface of the appliance is advantageous. In conventional hairdryers, the primary fluid inlet is generally located on the back end of the hairdryer and in an attempt to prevent blockage, the end is often convex. If the back end of the hairdryer is placed down on a hard surface, it will roll onto a side.

However, on a soft surface such as bedding or a long pile carpet, the inlet can still be at least partially covered or blocked. This can lead to overheating of the motor. By having the inlet on more than one surface, there is less chance of any blockage being sufficient to cause damage to the motor.

Preferably, the handle comprises an end wall at the second end and the second aperture extends through the end wall.

It is preferred that the end wall is substantially orthogonal to the handle.

Preferably, the first aperture is adjacent the second end of the handle.

It is preferred that the fan unit is upstream of the primary fluid inlet.

Preferably, the first aperture comprises a plurality of apertures extending at least partially around the handle.

It is preferred that the first aperture comprises a plurality of apertures extending at least partially along the handle.

Preferably, the second aperture comprises a plurality of apertures extending through the end of the handle.

Preferably, a power cable for supplying power to the fan unit is provided, the power cable extending through the end of the handle. It is preferred that the power cable extends substantially centrally thorough the handle at the primary fluid inlet. It is preferred that the second aperture extends at least partially around the power cable.

Preferably, a primary fluid flow path is provided from the primary fluid inlet through the handle and into the body to a primary fluid outlet.

It is preferred that the handle comprises a wall and the primary fluid flow path extends within the wall. It is preferred that the handle comprises an outer wall wherein said outer wall extends around the wall and at least partially along the wall. It is preferred that the handle comprises a layer of insulating material between the outer wall and the wall.

Preferably, the primary fluid outlet comprises a plurality of apertures extending at least partially along and around the body.

It is preferred that the primary fluid flow path is substantially linear through the handle and into the body Alternatively, the handle is substantially orthogonal to the body.

According to another aspect, the invention provides a hair care appliance comprising a body, and a handle having a first end in fluid communication with the body and a second end comprising a primary fluid inlet into the appliance wherein the primary fluid inlet comprises a first aperture extending at least partially around the handle and a second aperture extending through the second end of the handle wherein the handle is substantially orthogonal to the body.

It is preferred that the within the body the primary fluid flow path surrounds the fluid flow path.

It is preferred that the primary fluid outlet extends about the fluid flow path.

Also provided is a hand held hand held appliance comprising a body, and a handle having a first end in fluid communication with the body and a second end comprising a primary fluid inlet into the hand held appliance wherein the primary fluid inlet comprises a first aperture extending at least partially around the handle and a second aperture extending through the second end of the handle.

According to a fourth aspect, the invention provides hair care appliance comprising a handle, the handle comprising a wall and an outer wall wherein the wall defines a primary fluid flow path that extends from a primary fluid inlet into the appliance and the outer wall is an external surface of the appliance.

The provision of a double layered wall reduces the transmission of vibration and noise from within the handle. It isolates internal components of the handle from the outer wall.

Preferably, the outer wall extends substantially continuously around the wall. It is preferred that the outer wall extends substantially along the wall.

Preferably, the insulating layer mitigates one or more of noise, vibration and heat produced by the appliance. It is preferred that the insulating material is a foam or a felt.

It is preferred that the handle comprises a first end and a second end wherein the primary fluid inlet is at or near the second end.

Preferably, the handle includes a heater for heating fluid drawn into the primary fluid inlet.

Preferably, the heater is downstream of the fan unit. The heater is preferably, disposed adjacent the first end of the handle.

Preferably, the appliance comprises a head attachable to the handle, the head comprising a primary fluid outlet for the appliance. Preferably, the primary fluid outlet comprises a plurality of apertures extending at least partially along and around the head. Preferably, the primary fluid flow path is substantially linear through the handle and into the head.

Alternatively, the primary fluid flow path from the primary fluid inlet to the primary fluid outlet is non linear. It is preferred that the primary fluid flows within the handle in a first direction and within the body in a second direction. Preferably, the primary fluid flow in the body is substantially orthogonal to the primary fluid flow in the handle.

It is preferred that fluid in the fluid flow path is entrained into the body by the action of a fan unit in the primary fluid flow path.

According to a fifth aspect, the invention provides a hair care appliance comprising a body, a fluid flow path extending through the body from a fluid inlet to a fluid outlet and a printed circuit board (PCB) extending about the fluid flow path.

Preferably, the PCB is annular. It is preferred that the PCB is isolated from the fluid flow path.

Preferably, the PCB comprises a first layer and a second layer. It is preferred that the first layer extends substantially continuously about the fluid flow path. Preferably, the second layer extends partially about the fluid flow path.

It is preferred that the second layer is adjacent the first layer. Preferably, the second layer is downstream of the first layer.

It is preferred that the PCB extends at least partially around extends about the duct.

Preferably, the primary fluid flow path is in fluid communication with the PCB.

It is preferred that the heater is downstream of the PCB.

Preferably, a thermal barrier is provided between the PCB and the heater. The thermal barrier is located fluidly between the PCB and the heater.

Preferably, comprising a handle wherein the handle attached to and extending from the body and the primary fluid inlet is in the handle is connected to the body at a first end.

It is preferred that the handle comprises a fan unit for drawing fluid into the primary fluid flow path.

Preferably, the handle comprises a second end distal to the first end, the second end comprising a primary fluid inlet, It is preferred that the primary fluid flow path extends along the handle and into the body to a primary fluid outlet.

Preferably, the primary fluid flow path is non-linear.

It is preferred that within the handle the primary fluid flow path is generally circular.

Preferably, within the body the primary fluid flow path is generally annular.

It is preferred that where the primary fluid flow path enters the body a flow plate is provided. Preferably, the body comprises a flow plate for directing flow from the handle into the body.

Preferably, the flow plate deflects the primary flow around the duct from a circular to an annular flow.

It is preferred that the primary fluid flows through the handle in a first direction and in the body in a second direction. Preferably, the flow plate directs primary flow from the first direction to the second direction.

Preferably, the flow plate is provided in the primary fluid flow path to direct flow from a circular flow in the handle to an annular flow in the body. Preferably, the flow plate is adjacent to the PCB.

Preferably, the flow plate is shaped around components on the PCB.

Preferably, the flow plate deflects the primary flow from a first direction of flow within the handle to a second direction of flow within the body.

Preferably, the fan unit is upstream of the PCB.

According to a sixth aspect, the invention provides a hair care appliance comprising a body, a heater, a PCB and a primary fluid flow path extending from a primary fluid inlet into the appliance to a primary fluid outlet out of the body wherein the PCB and heater are in fluid communication with the primary fluid flow path and the PCB is upstream of the heater.

Preferably, a fan unit is provided and the fan unit is upstream of the heater.

Alternatively, a fan unit is provided and the fan unit is downstream of the PCB.

It is preferred that the thermal barrier is in thermal communication with the PCB and functions as a heat sink for the PCB. Preferably, the thermal barrier is aluminium or an alloy of aluminium.

It is preferred that the body includes a handle portion upstream of the heater. Preferably, the primary fluid inlet is in the handle portion. It is preferred that the primary fluid flow path extends linearly through the body.

Preferably, the flow plate comprises at least one aperture. It is preferred that the at least one aperture enables fluid to flow through the flow plate to the PCB.

Preferably, the flow plate is connected to the PCB. The flow plate acts as a heat sink for the PCB. It is preferred that the flow plate additionally directs primary fluid flow around the PCB.

Preferably, the flow plate is additionally one or more of a thermal barrier, heat sink and deflector plate for the PCB.

It is preferred that where the primary flow enters the body there is a region of relatively high velocity flow.

Preferably, the PCB comprises components extending outwards from a board by different amounts and the components are arranged such that components that extend further out from the board are positioned radially away from the region of relatively high velocity flow. It is preferred that at least some of the components that extend further out from the board are capacitors.

Preferably, components that extend less distance from the board are positioned in the region of relatively high velocity flow.

It is preferred that the thermal barrier is additionally a deflector plate for deflecting debris from the PCB away from the primary fluid flow path and the primary fluid outlet.

According to a seventh aspect, the invention provides a hair care appliance comprising a body, a PCB having electrical components mounted thereon and a primary fluid flow path extending at least partially through the body and passed the PCB, wherein the primary fluid flow path has a region of relatively high velocity and a region of relatively low velocity and components mounted on the PCB are arranged so that larger components are in the region of relatively low velocity.

Preferably, the appliance comprises a handle connected to the body at a first end wherein the primary fluid flow path flows through the handle into the body.

It is preferred that the primary fluid flow path extends in a first direction within the handle and a second direction within the body.

Preferably, the body is generally tubular and has an upper half and a lower half and the handle is connected to the lower half. It is preferred that the region of relatively high velocity is in the lower half of the body. Preferably, the region of relatively low velocity is in the upper half of the body.

It is preferred that larger components of the PCB are located in the upper half of the body. Preferably, smaller components of the PCB are located in the lower half of the body. It is preferred that larger components of the PCB are components which extend the furthest from a circuit board on which they are mounted.

According to an eighth aspect, the invention provides, a hair care appliance comprising a body, a fluid flow path extending through the body from a fluid inlet through which a fluid flow enters the appliance to a fluid outlet for emitting the fluid flow from a front end of the body, and an attachment for adjusting at least one parameter of fluid emitted from the appliance, the attachment comprising an upstream end for attaching to the appliance, wherein one or both of the front end of the body and the upstream end of the attachment comprises at least one magnet.

Preferably, the front end of the body comprises an end wall extending radially inwards of the body and the end wall comprises at least one magnet.

It is preferred that end wall comprises a plurality of magnets radially spaced about the end wall.

Preferably, the end wall comprises a ring of magnetic material extending around the end wall.

Preferably, the end wall comprises an outer face and an inner face, the outer face being an external surface of the appliance, wherein the at least one magnet is adjacent the inner face.

It is preferred that the at least one magnet is embedded in the end face.

Preferably, the upstream end of the attachment comprises an end face and a plurality of magnets radially spaced about the end face.

It is preferred that the upstream end of the attachment comprises a ring of magnetic material extending around the end face.

Preferably, the magnet or magnetic material is made from a polymer containing magnetic flakes.

It is preferred that an external surface of the magnet or magnetic material is coated with an anti scratch coating.

Preferably, the appliance comprises a primary fluid flow path extending at least partially through the body from a primary fluid inlet through which a primary fluid flow enters the appliance to a primary fluid outlet.

It is preferred that the appliance comprises a handle wherein the primary fluid inlet is in the handle.

Preferably, fluid flow is drawn through the fluid flow path by fluid emitted from the primary fluid outlet.

It is preferred that the primary fluid flow extends about the duct.

Preferably, the attachment is configured to inhibit emission of the fluid flow from the appliance. It is preferred that the attachment includes means to inhibit generation of a fluid flow along the fluid flow path to the fluid outlet.

Preferably, the means to inhibit the generation of a fluid flow comprises a barrier which blocks the duct when the attachment is attached to the appliance.

It is preferred that the attachment is in the form of a nozzle defining a nozzle fluid flow path extending from a nozzle fluid inlet through which the primary fluid flow enters the nozzle to a nozzle fluid outlet for emitting the primary fluid flow.

Preferably, the attachment has an outer wall that substantially continues the profile of the body at the front end of the body.

It is preferred that the body reduces in diameter towards the front end of the body. Preferably, the reduction in diameter has a constant gradient.

It is preferred that the appliance comprises a body, a fluid flow path extending through the body from a fluid inlet through which a fluid flow enters the appliance to a fluid outlet for emitting the fluid flow from a front end of the body wherein the front end of the body comprises at least one magnet.

Preferably, the front end of the body comprises an end wall extending radially inwards of the body and the end wall comprises at least one magnet.

It is preferred that the end wall comprises a plurality of magnets radially spaced about the end wall.

Preferably, the end wall comprises a ring of magnetic material extending around the end wall.

The invention also provides an attachment for adjusting at least one parameter of fluid emitted from the appliance comprising an upstream end for attaching to the appliance, wherein the upstream end of the attachment comprises at least one magnet.

According to a ninth aspect, the invention provides a hair care appliance having a handle, and a body, the body having an outer wall and a duct wherein the outer wall extends about the duct and the outer wall converges towards the duct.

Preferably, the outer wall has a first part and a second part and the first part is tubular.

It is preferred that the first part is of substantially uniform diameter.

Preferably, the second part is cone shaped.

It is preferred that the second part of the outer wall converges towards the duct at an angle of between 1 and 89°.

Preferably, the second part of the outer wall converges towards the duct at an angle of between 30 and 60°.

Preferably, the appliance comprises a fan unit for drawing fluid into the primary fluid flow path from a primary fluid inlet to a primary fluid outlet.

It is preferred that the body comprises the primary fluid outlet at one end and wherein the outer wall converges towards the duct towards the primary fluid outlet.

Preferably, the body has a first end and a second end and the outer wall converges towards the duct at the second end of the body.

Preferably, the appliance comprises a handle having a primary fluid inlet in fluid communication with the primary fluid flow path.

It is preferred that fluid is entrained into the fluid flow path by the action of a fan unit drawing fluid into the primary fluid flow path.

Preferably, the primary fluid flow path extends about the fluid flow path.

BRIEF DESCRIPTION OF THE DRAWINGS

The invention will now be described by way of example with reference to the accompanying drawings, of which.

DETAILED DESCRIPTION OF THE INVENTION

Figure 1:
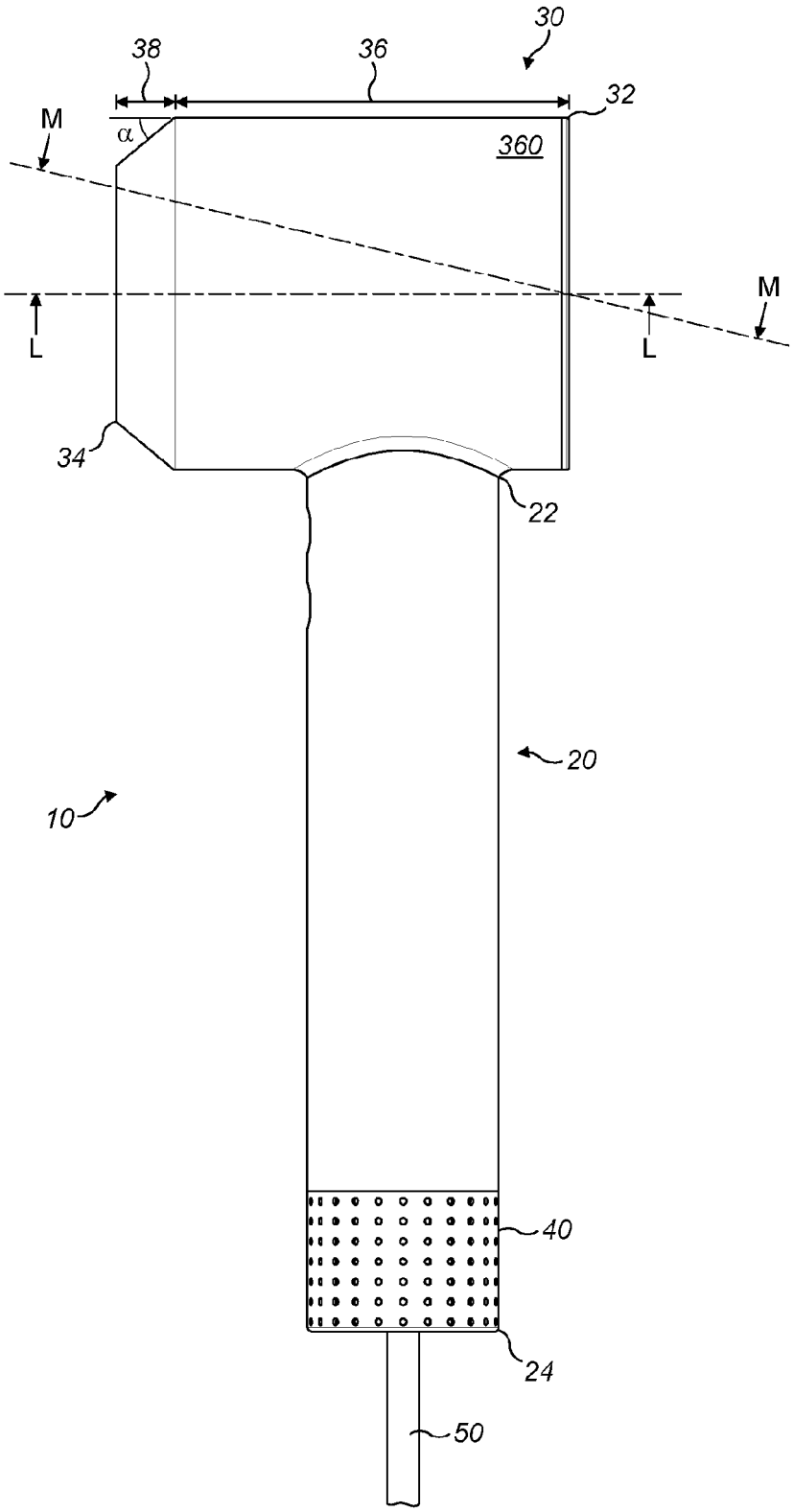
FIGS. 1 and 2 show different aspects of a hairdryer according to the invention.
Figure 2:
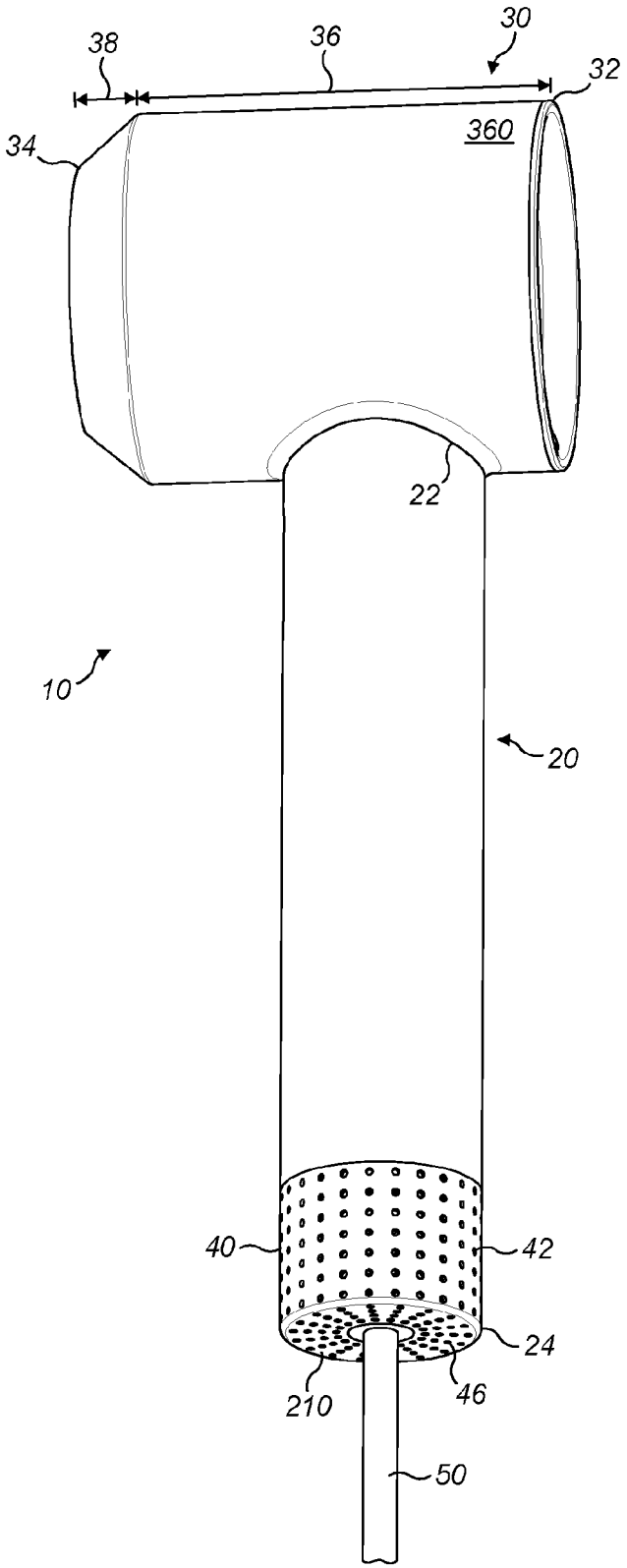

FIGS. 1 and 2 show a hairdryer 10 with a handle 20 and a body 30. The handle has a first end 22 which is connected to the body 30 and a second end 24 distal from the body 30 and which includes a primary inlet 40. Power is supplied to the hairdryer 10 via a cable 50.

The body 30 has a first end 32 and a second end 34 and can be considered to have two parts. A first part 36 which extends from the first end 32 which is tubular and of a generally consistent diameter and a second part 38 which extends from the second end 34 to join the first part 36. The second part 38 is cone shaped and varies in diameter along its length from the diameter of the first part 36 of the body 30 to a smaller diameter at the second end 34 of the body. In this example, the second part 38 has a constant gradient and the angle $\alpha$ subtended from the outer wall 360 of the first part 36 of the body 30 is around 40°.

Referring now to FIGS. 2, 3, 4*a* and 4*b* in particular the handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary inlet 40 in the handle 20 includes first apertures that extend around and along 42 the outer wall 200 of the handle and second apertures that extend across 46 and through the end wall 210 of the handle 20. The cable 50 is located approximately in the middle of the end wall 210 so extends from the centre of the handle 20. The end wall 210 is orthogonal to the outer wall 200 and inner wall 220 of the handle.

It is preferred that the cable 50 extends centrally from the handle 20 as this means the hairdryer is balanced regardless of the orientation of the handle 20 in a users' hand. Also, if the user moves the position of their hand on the handle 20 there will be no tugging from the cable 50 as it does not change position with respect to the hand when the hand is moved. If the cable were offset and nearer one side of the handle then the weight distribution of the hairdryer would change with orientation which is distracting for the user.

Upstream of the primary inlet 40, a fan unit 70 is provided. The fan unit 70 includes a fan and a motor. The fan unit 70 draws fluid through the primary inlet 40 towards the body 30 through a fluid flow path 400 that extends from the primary inlet 40 and into the body 30 where the handle 20 and the body 30 are joined 90. The fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the duct 310 towards the primary fluid outlet 440 at the second end of the body 30.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the duct 310 which is an inner wall of the body 30 and extends within and along the body. A fluid flow path 300 extends within the duct from the fluid inlet 320 to the fluid outlet 340. At the first end 32 of the body 30, a side wall 350 extends between the outer wall 360 and the duct 310. This side wall 350 at least partially defines the fluid inlet 320. At the second end 34 of the body a gap 370 is provided between the outer wall 360 and the duct, this gap 370 defines the primary fluid outlet 440. The primary fluid outlet 440 is annular and surrounds the fluid flow path. The primary fluid outlet 440 may be internal so the primary fluid flow path 400 merges with the fluid flow path 300 within the body 30. Alternatively, the primary fluid outlet 440 is external and exits from the body 30 separately to the fluid from the fluid flow path 300 at the fluid outlet 340.

The outer wall 360 of the body converges towards the duct 310 and a centre line A-A of the body 30. Having an outer wall 360 that converges towards the duct 310 has the advantage that the primary flow exiting the primary fluid outlet 440 is directed towards the centre line A-A of the body 30. The fluid exiting the primary fluid outlet 440 will cause some external entrainment of fluid 490 from outside the hairdryer due to the movement of the fluid from the primary outlet 440. This effect is increased by the outer wall 360 converging towards the duct 310. Partly this is because the primary flow is focused rather than divergent and partly this is because of the slope of the outer wall 360 of the body 30 towards the second end 34 of the hairdryer.

Figure 4B:
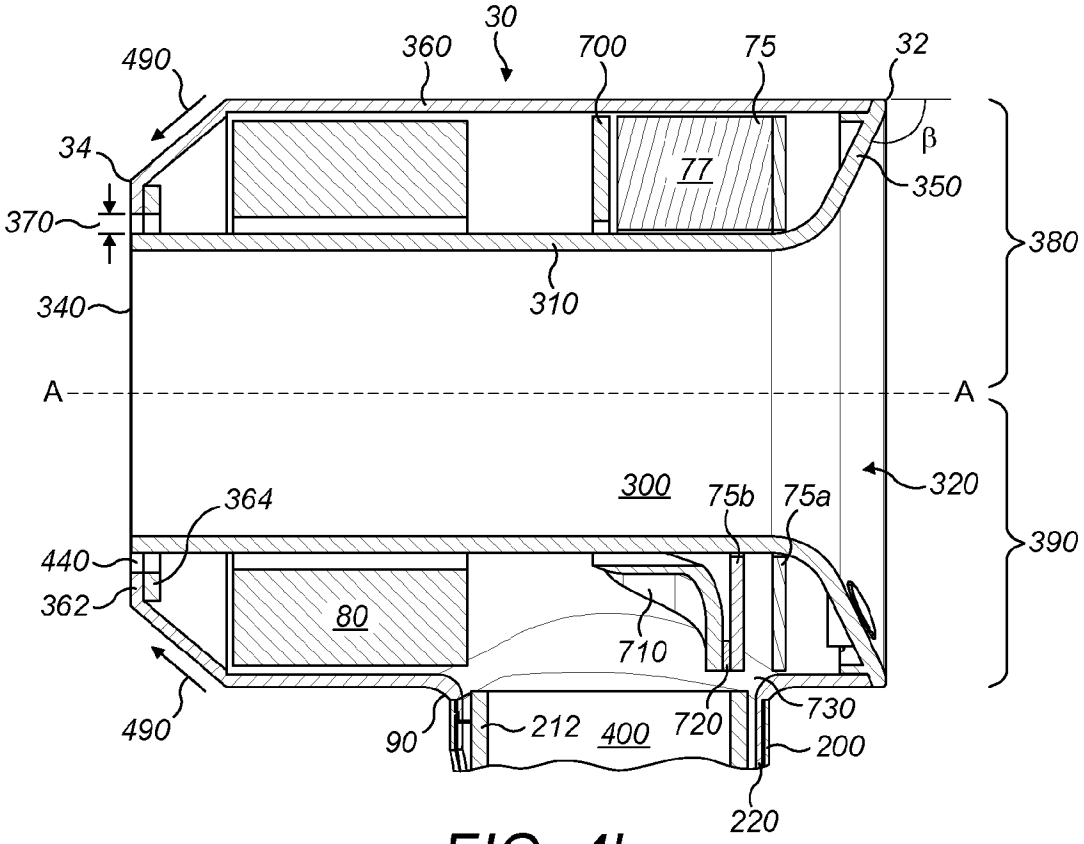
FIGS. 4*a* and 4*b* show enlarged views of portions of the cross section of FIG. 3.

The duct 310 is an internal wall of the hairdryer that can be accessed from outside the hairdryer. Thus, the duct 310 is an external wall of the hairdryer. The duct 310 is recessed within the body 30 so the side wall 350 that connects between the outer wall 360 and the duct 310 is angled with respect to the outer wall 360. The angle β is around 115° from a line subtended by the outer wall 360 of the body 30 (FIG. 4*b*).

A PCB 75 including the control electronics for the hairdryer is located in the body 30 near the side wall 350 and fluid inlet 320. The PCB 75 is ring shaped and extends round the duct 310 between the duct 310 and the outer wall 360. The PCB 75 is in fluid communication with the primary fluid flow path 400. The PCB 75 extends about the fluid flow path 300 and is isolated from the fluid flow path 300 by the duct 310.

The PCB 75 controls such parameters as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 3, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Figure 5:
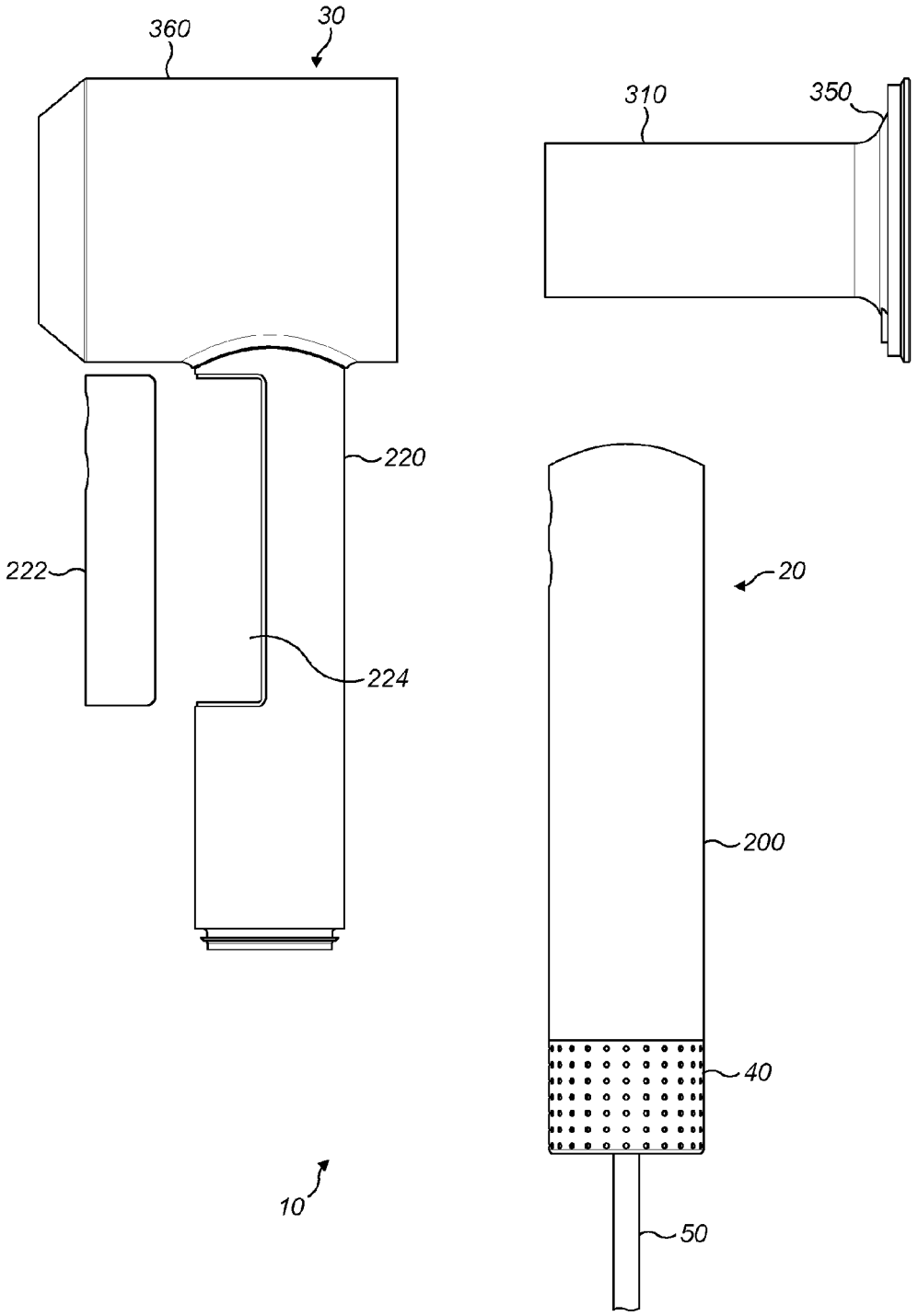
FIGS. 5, 6 and 7 show different views of parts of a hairdryer according to the invention.
Figure 6:
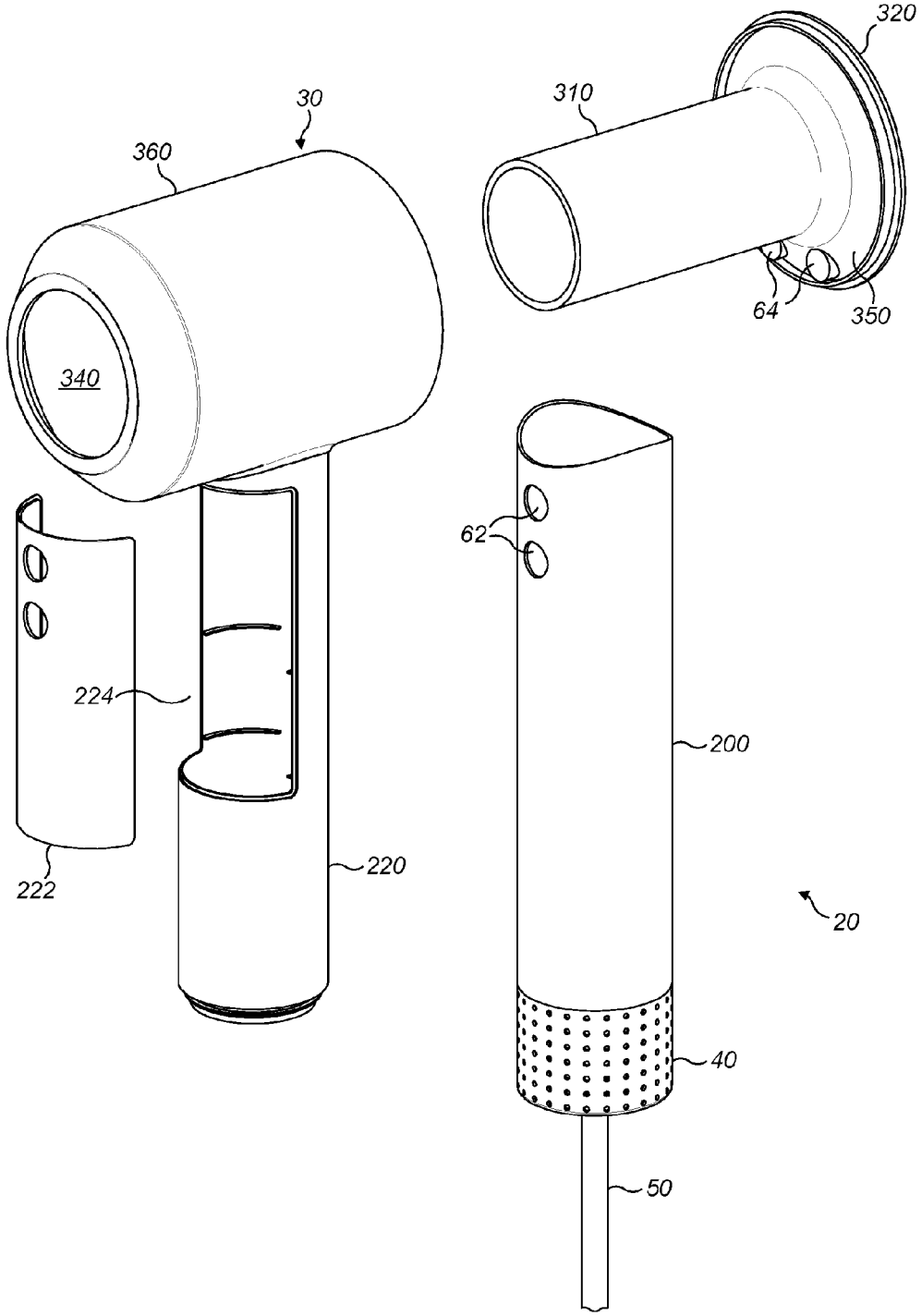
Figure 7:
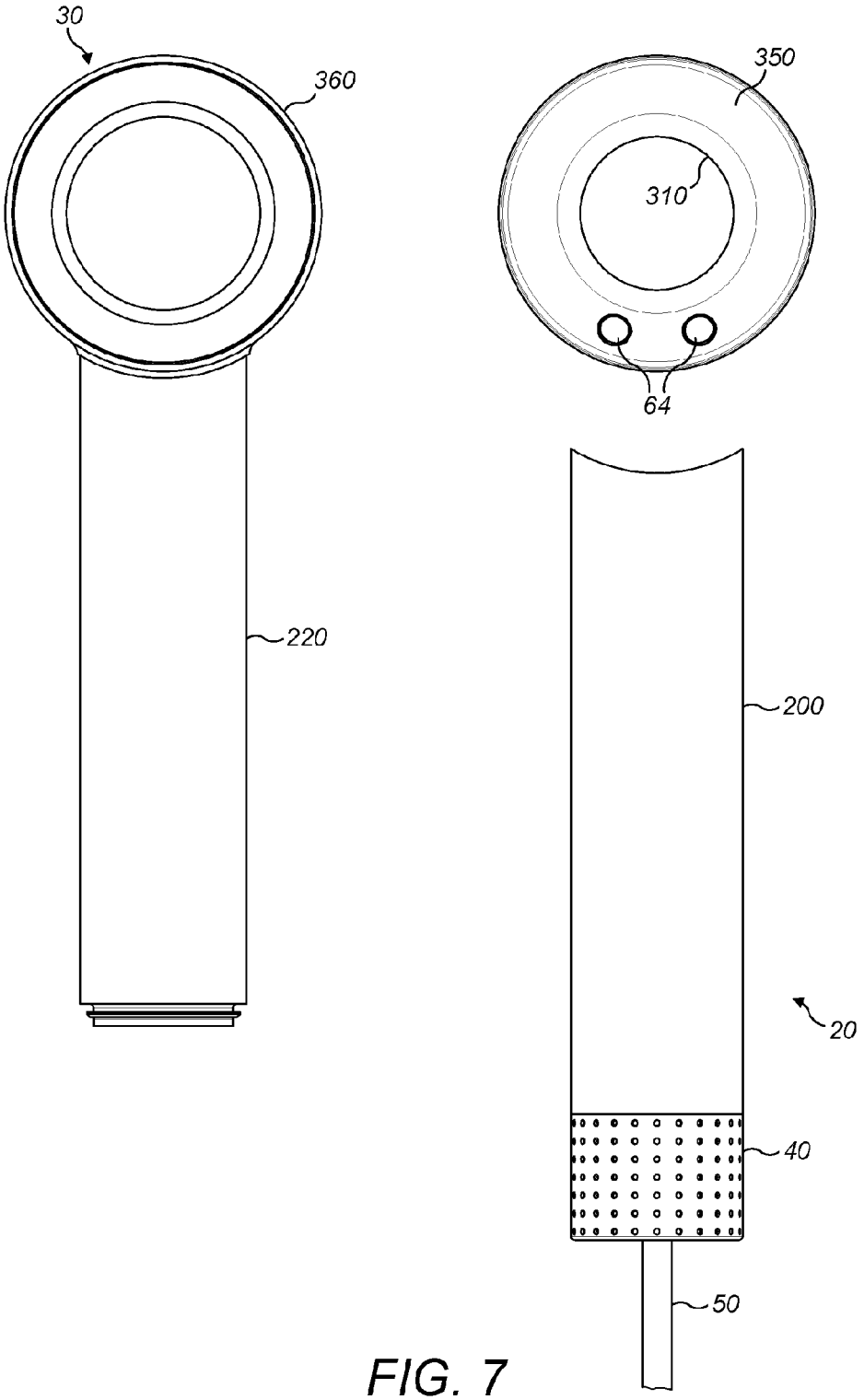

FIGS. 5 to 7 all show exploded views of the different parts that the hairdryer 10 is formed from. Instead of a conventional clamshell hairdryer having two outer parts which require external fixings such as screws this hairdryer is made without such external fixings.

A first piece is the outer wall 200 of the handle 20 including the primary inlet 40 and cable 50. A second piece comprises the duct 310 and side wall 350 of the body 30. A third piece is the outer wall 360 of the body 30 and an inner wall 220 of the handle 20. The second and third pieces are manufactured as single units. This has two advantages; a first is that it enables tight tolerances to be reproduced between the duct 310 and the outer wall 360 of the body 30 and the second is that there are no unseemly joins in the body 30. By manufacturing the hairdryer out of these three main components, both the function and the form of the hairdryer are easily maintained. In addition, there is a safety aspect as an end user would find is difficult to dissemble the hairdryer using normal household tools.

The third piece comprising outer wall 360 of the body 30 and inner wall 220 of the handle 20 are moulded as a one piece unit from a plastic material. The second piece comprising the duct 310 and the side wall 350 is also moulded from a plastic material. Suitable plastic materials include polycarbonate, glass-filled PPA (Polyphthalamide), PPS (Polyphenylene Sulphide), LCAP (Liquid Crystal Aromatic Polymer) or PEEK (Polyether ether ketone) and the skilled person will appreciate that this list is not exhaustive. The outer wall 200 of the handle 20 can be made from any of a number of suitable materials but is preferably made from aluminium, an alloy of aluminium a steel or a stainless steel.

In order to assembly internal components of the hairdryer an access hatch 222 is provided in the inner wall 220 of the handle 20. This enables the fan unit 70 to be positioned and wiring that connects the fan unit 70, the heater 80, control buttons 62, 64 and PCB 75 to the cable 50 to be connected simply and with relative speed. The heater 80 and PCB 75 are located around the duct 310 which is inserted into the body 30, the wiring is connected and the access hatch 222 is placed over the corresponding hole 224 in the inner wall 220 of the handle 20. The side wall 350 seals the first end 32 of the body 30. This stops both two things, fluid being entrained into the primary fluid flow path 400 at the first end 32 of the body and fluid that has been processed by the fan unit 70 from exiting the body 30 at the first end 32.

In the example shown with respect to FIGS. 5, 6 and 7 the control buttons 62 on the handle are on the side of the handle that faces the fluid outlet 340.

The hatch 222 needs to be of a size large enough to enable wiring connections to be made to the electrical components and can be at any location around the handle. The hatch may extend for the whole length of the inner wall 220 and is locatable at any orientation around the inner wall 220.

Referring now particular for FIGS. 3, 4*a* and 5 to 7, the construction of the handle will be discussed. The handle 20 has an outer wall 200 and an inner wall 220. The inner wall 220 is a duct which surrounds and defines a primary fluid flow path 400 through the hairdryer. The outer wall 200 includes a grippable portion and in this example, includes the primary inlet 40 into the primary fluid flow path 400. Within the inner 220 wall, an insulting layer of material 212 is provided. The insulating layer is a foam or a felt and insulates the handle from noise produced by the fan unit 70, heat produced by the operation of the hairdryer, vibrations caused by the fan unit and noise produced within the hairdryer by the flow of fluid through the primary fluid flow path 400.

Alternatively or additionally, insulating layer of material 212 is provided between the outer wall 210 and inner wall 220. This is described in relation to FIG. 8*a*.

As a minimum, the insulating material 212 is positioned around the fan unit 70 and preferably around the access hatch 222. However, it is preferred that the insulating material 212 is substantially continuous around the inner 220 wall and extends for the length of the inner wall 220 of the handle as this has the most impact on insulating the handle. The insulating material 212 may also extend around the primary inlet 40 to reduce any noise produced directly by fluid being drawn into the primary fluid flow path 400.

In this example, the outer wall 200 includes the primary fluid inlet 40; however it is not essential that the outer wall extends over the entire length of the inner wall 20. The outer wall 200 should extend over the access hatch 222 and the region of the handle 20 that contains the fan unit 70 for insulation purposes and for aesthetic and safety reasons to both hide and prevent access to the access hatch 222 by a user. In the event that the outer wall 200 does not extend the entire length of the inner wall 220, then either the inner wall 220 would comprise the inlet 40 at its' distal end from the junction 90 with the body 30 or a separate inlet body attachable to the outer wall 200 and/or inner wall 220 could be provided.

The outer wall 200 is positioned with respect to the inner wall 220 and then secured in place. The outer wall 200 is for example, secured by plasma welding as this prevents user removal and thus access to sensitive components and also provides a clean join.

Figure 8A:
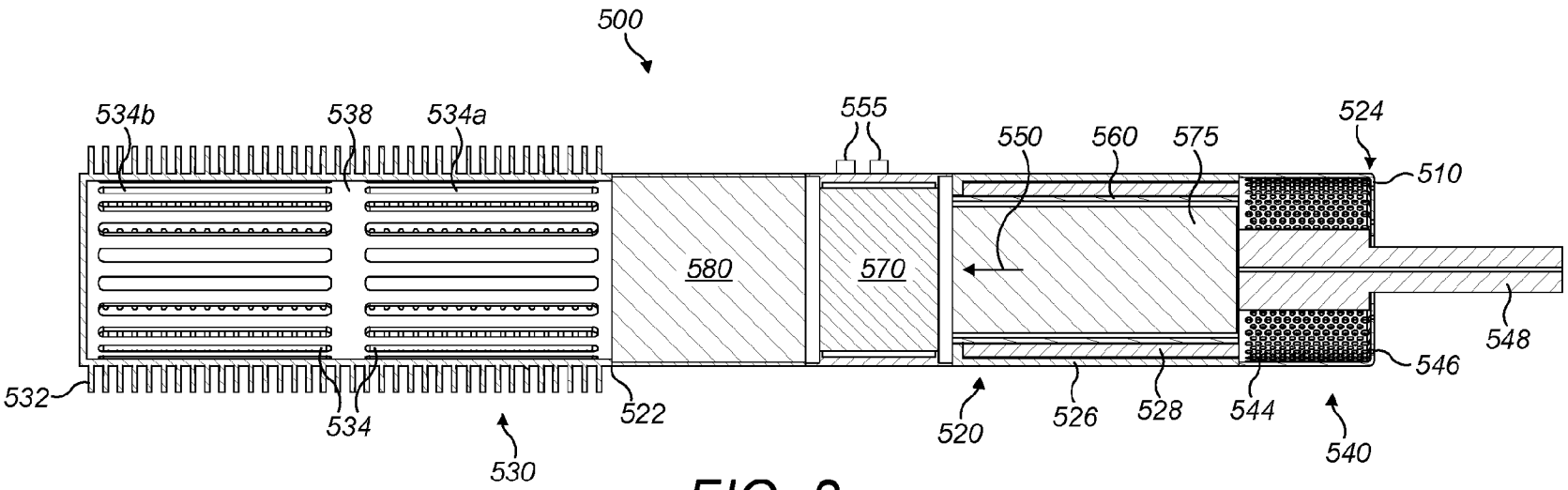
FIGS. 8*a* and 8*b* show respectively a cross section through and a perspective of alternate hair care appliance.
Figure 8B:
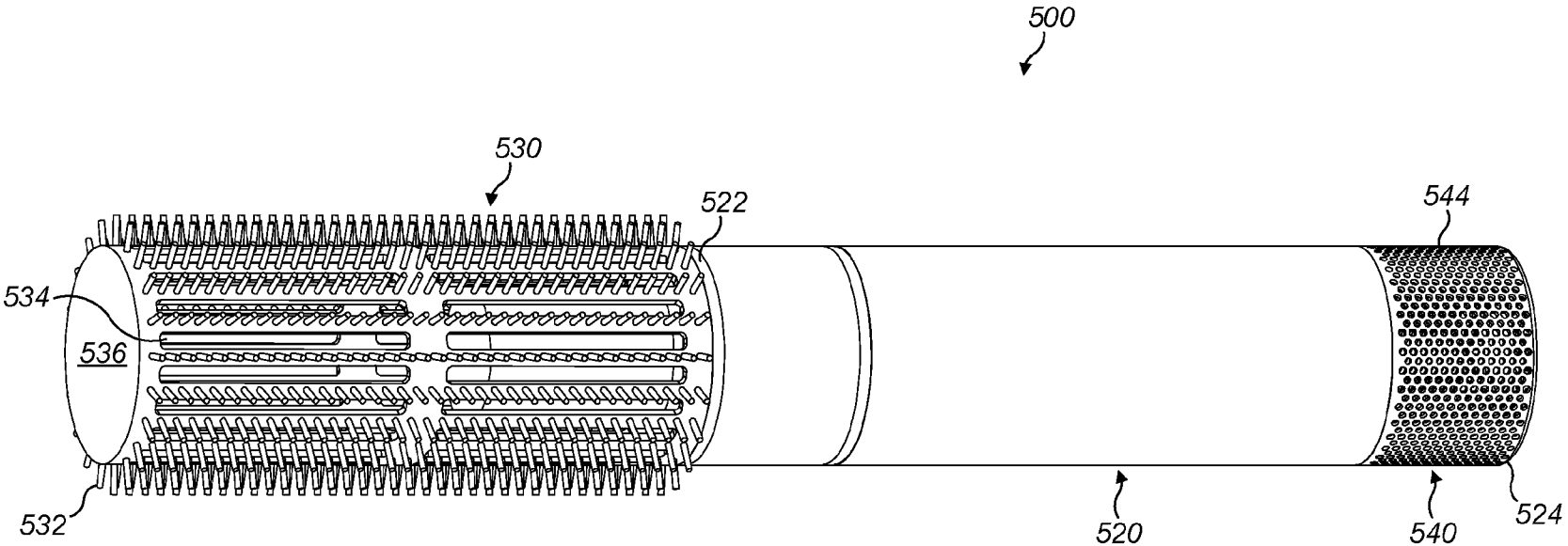

FIGS. 8*a* and 8*b* show an alternate hair care appliance having a similar primary inlet 540. In this example, the hair care appliance is a hot styling brush 500 and it has a handle 520 and a detachable head 530 which is attachable at the distal end 522 of the handle 520 to the primary inlet 540.

The handle 520 has an outer wall 526 which is generally tubular and includes the primary inlet 540 at and adjacent one end 524. The primary inlet 540 comprises a first set of apertures 544 which extend radially around the handle 520 and along the outer wall 526 of the handle from the handle end 524. The handle end 524 is covered by an end wall 510 which is also perforated with a second set of apertures 546 that extend through the end wall 510 of the handle. Thus, the primary inlet 540 extends around, along and across the handle 520. The end wall 510 is orthogonal to the outer wall 526 and inner wall 560 of the handle.

The handle 520 also includes a fan unit 570 which comprises a fan and a motor which drives the fan and in use, draws fluid in through the primary inlet 540, along a fluid flow path 550 which extends through the length of the handle 520. The fluid is optionally heater by a heater 580 before entering an inner cavity 538 of the head 530.

The head 530 includes a fluid outlet which in this example comprises two sets of parallel slots 534 each extending towards an end 536 of the head and radially around the head 530 with one set of slots 534*a* being upstream of a second set of slots 534*b*. This arrangement enables fluid to exit the head all the way around the head and for the majority of the length of the head 530 maximising a hair styling region of the product.

The head 530 also includes bristles 532 which extend radially away from the head 530. The bristles 532 are formed as parallel lines which extend radially around the head. Each set of bristles is located between two adjacent slots 534 but bristles need not be provided between every pair of slots.

In use, hair is wrapped around the head 530. The bristles 534 retain the hair whilst hot air or fluid exits through the slots drying the hair and styling the hair into curls or waves.

Power is provided to the appliance via a power cable 548 which preferably extends from a plug or other power source through the end wall 510 of the handle 520. The handle 520 also houses a PCB 575 which is electrically connected to the cable 548, the fan unit 570 and the heater 580 by internal wiring (not shown). Control buttons 555 are provided and connected to the PCB 575 to allow the user to select one of a range of temperature and flow settings. The control buttons 555 are push buttons or slide buttons, for example.

The handle 520 has an outer wall 526 and an inner wall 560. The inner wall 560 is a duct which surrounds and defines a fluid flow path 550 through the appliance. The outer wall 526 includes a grippable portion and in these examples, includes the primary inlet 540 into the fluid flow path 550. In between the outer 526 and inner 560 walls, an insulting layer of material 528 is provided. The insulating layer is a foam or a felt and insulates the handle from noise produced by the fan unit 570, heat produced by the operation of the appliance, vibrations caused by the fan unit and noise produced within the appliance by the flow of fluid through the fluid flow path 550.

As a minimum, insulating material is positioned around the fan unit 570. However, it is preferred that the insulating material 528 is substantially continuous between the outer 526 and inner 560 handles and extends for the length of the inner wall 560 of the handle as this has the most impact on insulating the handle. The insulating material 528 may also extend around the primary inlet 540 to reduce any noise produced directly by fluid being drawn into the fluid flow path 550.

The primary inlet 40, 540 comprises a plurality of apertures extending around, along and across the handle 20, 520. Having an inlet that extends in three dimensions has advantages particularly when used with hair grooming appliances. Firstly, if the appliance is placed on a surface whilst switched on only a small part of the inlet surface area will be blocked or have restricted flow of fluid into the appliance. This protects the fan unit and particularly the motor of the fan unit from running with too low a flow rate as this can cause overheating of the motor and cause damage to the motor.

Secondly, often hair care appliances are used with a styling product such as a mousse, gel or spray. These products are typically either applied by a hand or directly to the hair as a mist. After application by a hand, some of the product will be retained on the skin which is then transferred to the appliance when held. This can block at least some of the apertures 42, 544 that extend around and along the handle 20, 520. However, the apertures 44. 546 that extend under the handle and across the end wall 210, 510 of the handle will be unaffected. When a product is applied as a mist, it can settle on the appliance and again block or restrict at least some of the apertures of the primary inlet 40, 540. However, by having apertures that extend around along and across the handle 20, 520 the risk of blocking the primary inlet 40, 540 is reduced.

The apertures are preferably circular with a diameter of 0.2 to 1.6 mm. The diameter of the apertures can vary along, around and across the handle 20, 520. It is advantageous to space the apertures regularly around, along and across the primary inlet 40, 540. Not only is this visually pleasing but it also has the technical advantage that there is no weak region of the primary inlet 40, 540 where blockage of a portion is more likely or would have more impact on the flow into the primary inlet 40, 540. The inlet is designed so that the flow into the inlet is even at least around the circumference of the handle 20, 520.

It is preferred that the handle is made from a metallic material so any styling product that sticks to the handle and does block the primary inlet 40, 540 is easily removed and only temporarily blocks any apertures.

Figure 9:
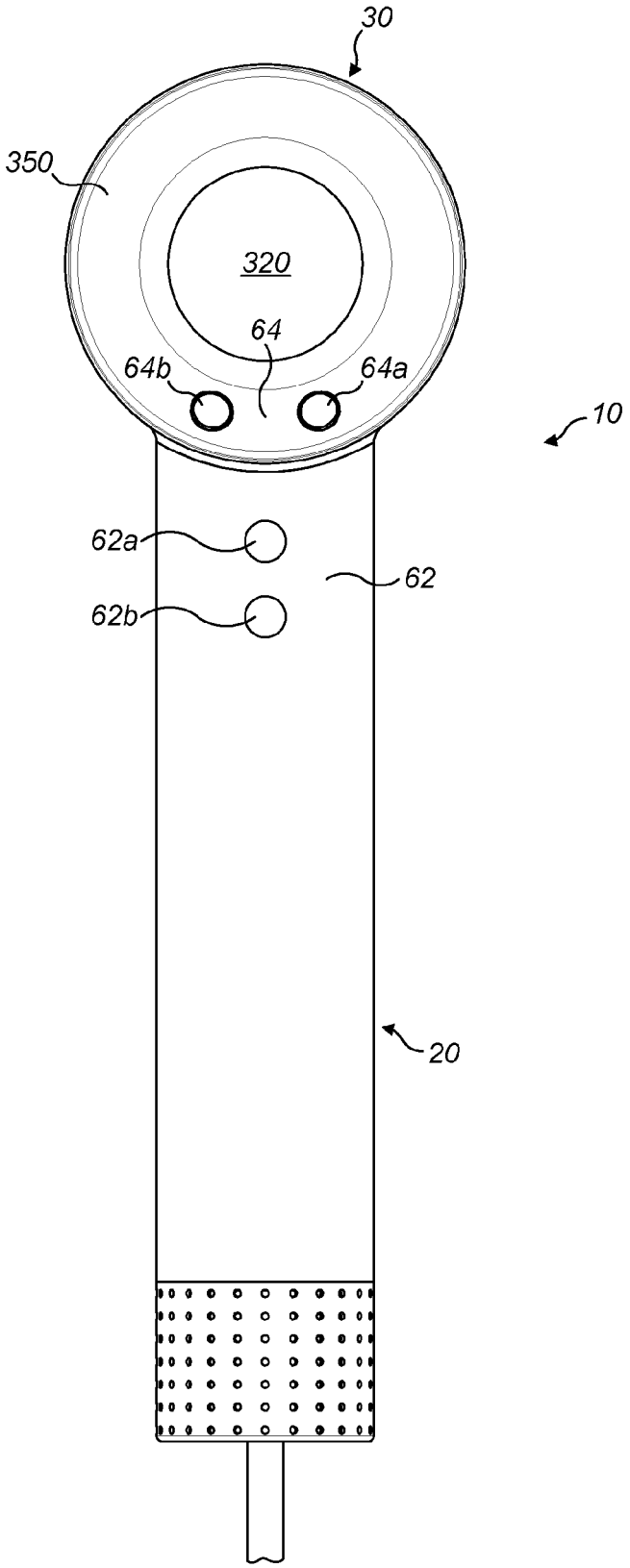
FIGS. 9 and 10 show different views of a hairdryer according to the invention.
Figure 10:
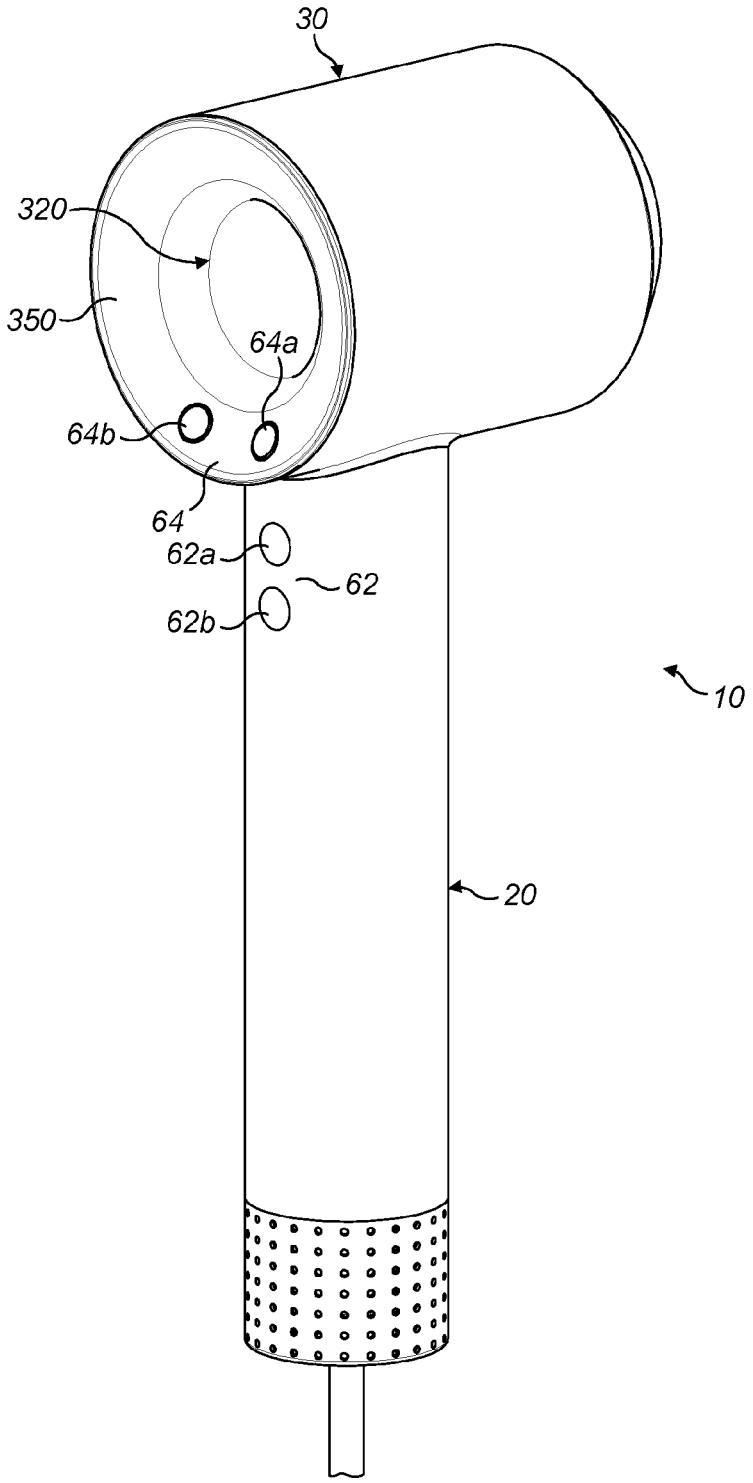
Figure 11A:
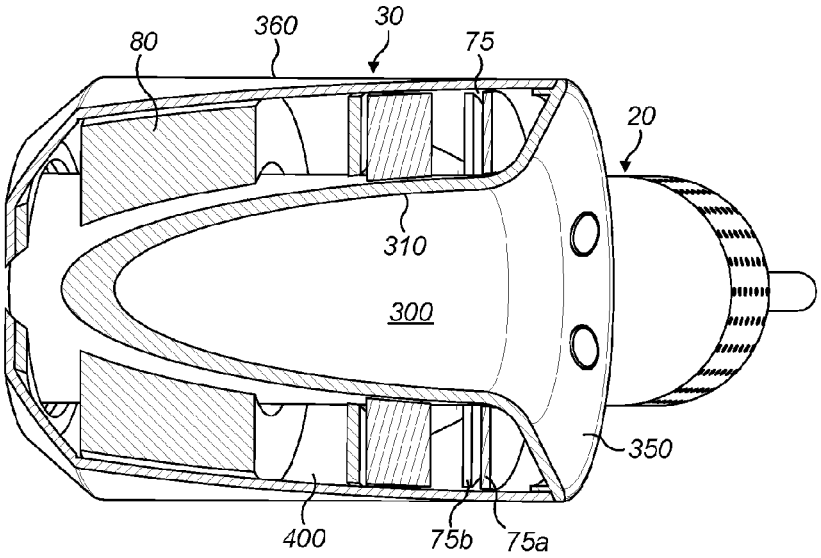
FIG. 11*a* shows a top sectional view along line M-M of FIG. 1.
Figure 11B:
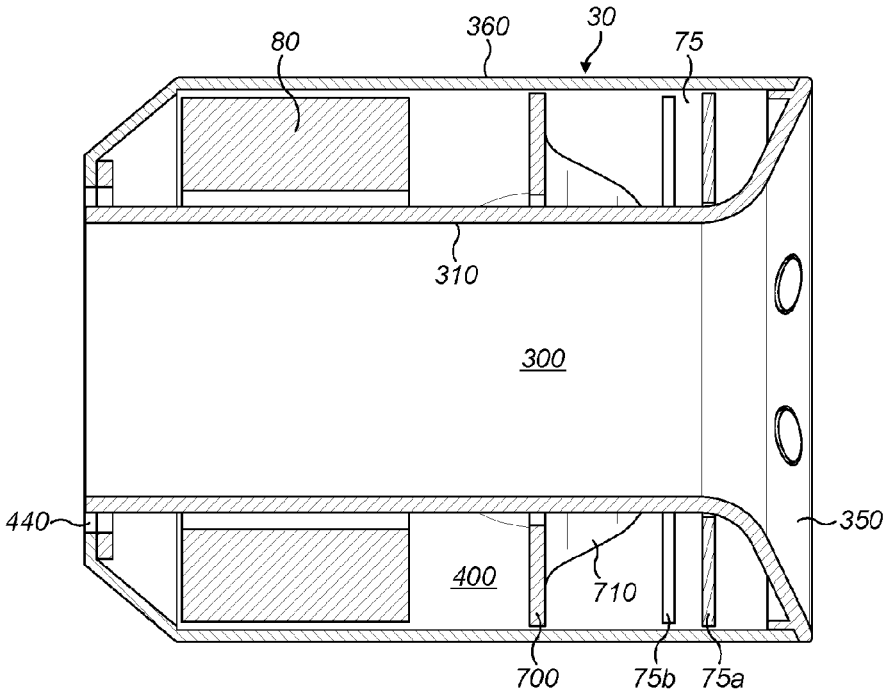
FIG. 11*b* shows a top sectional view along line L-L of FIG. 1.

Referring now to FIGS. 9 and 10, the hairdryer 10 includes two sets of control buttons 62, 64. A first set 62 is provided on the handle 20 and a second set 64 on the body 30. Conveniently, the two sets of buttons 62, 64 are located so they can all be accessed by one digit. In normal use this digit is the thumb, but if the hairdryer is held differently it may be a finger. The first set 62 are provided on the handle 20 on the same side of the handle 20 as the body inlet 320. The second set 64 are provided on the side wall 350 of the body 30. An as example, the first set 62 can include an on button 62*a* and a cold shot button 62*b* and the second set 64 can include a heater control button 64*a* and a flow control button 64*b*.

One advantage of having the buttons located on one side or end of the hairdryer is that all the control buttons 62, 64 can be seen by a user at the same time making use of the hairdryer and changes to parameters such as flow rate and temperature simplified.

Another advantage is that the control electronics are in one region of the handle 20. This is particularly advantageous when the primary flow path 400 is through the handle as there are is no wiring to be routed around the handle to the front face i.e. that side of the handle 20 that faces the outlets 340, 440 of the hairdryer.

A third advantage is that the second set of control buttons 64 is mounted directly onto the PCB 75. This not only simplifies the production of the hairdryer but also improves reliability as there are fewer electrical connections within the hairdryer.

The control buttons 62, 64 can be depressible buttons or slidable controls or a mixture of differently actuated controls. It is preferred that the control buttons 62, 64 stand proud of the surface in which they are located as this enables a user to find the required button by feel alone.

The PCB 75 will now be discussed in particular with reference to FIGS. 3, 4*b*, 11*a*, 11*b*, 12*a* 12*b*, and 12*c*. The PCB 75 is annular or ring shaped and extends around the duct 310 and between the duct 310 and the outer wall 360. In this example, the PCB has two boards, a first board 75*a* which extends all the way round the duct 310 and a second board 75*b* adjacent of and downstream of the first board 75*a*. The second board 75*b* extends only partially around the duct 310 and about the fluid flow path 300.

The PCB 75 houses a number of different components each of which extend away from the board on which it is mounted by a different amount. Referring in particular to FIGS. 3, 4*b*, 12*a* 12*b*, and 12*c*, large components 77 such as capacitors, are positioned on the first board 75*a* radially away from the second board 75*b*. This has a number of advantages such as the PCB 75 is made as compact as possible as the smaller components or those which extend least away from the board on which they are mounted are double stacked whereas the larger components or those that extend the furthest from the board on which they are mounted are single stacked.

Another advantage to this arrangement on the PCB 75 in is flow management of fluid in the primary fluid flow path 400 as the primary fluid flow path moves from the handle 20 into the body 30. Referring to FIGS. 3, 4*b* 12*b*, and 12*c*, the handle 20 is generally tubular and the primary fluid flow path 400 is generally circular as it enters the junction 90 between the handle 20 and the body 30. At this point the primary fluid flow path 400 changes direction by 90° and from a circular flow to an annular flow around the duct 310 between the duct 310 and the outer wall 360 of the body 30. These changes affect the velocity of flow in the primary fluid flow path 400.

If we consider that the body 30 is generally symmetrical about a centre line A-A which extends along the length of the body 30, the duct 310 and outer wall 360 are concentric as is the heater 80 located between the duct 310 and the outer wall 360. When the fluid in the primary fluid flow path 400 reaches the junction 90 between the body 30 and the handle 20, the fluid must change both direction and shape. This creates a region of high velocity flow in the body 30 by the junction 90 and a region of lower velocity flow radially spaced within the body 30 from the junction 90. If we consider the body 30 to have an upper half 380 and a lower half 390 where the upper half 380 is radially spaced away from the handle 20 and the lower half 390 includes the junction 90 between the body 30 and the handle 20 then the lower half 390 has flow at a relatively higher velocity than the upper half 380.

The PCB 75 is orientated so that larger components 77 are located in the upper half 380 in the relative lower velocity flow radially away from the region of relatively high velocity so that their impact on the velocity of flow within the hairdryer is reduced. The double layer 75*a*, 75*b* PCB is located in the lower half 390 as this part of the PCB 75 extends less into the primary fluid flow path 400.

In addition, a flow plate 700 is provided to curve or direct the flow within the primary fluid flow path 400 over and around the PCB 75 to further minimise any pressure losses due to the location of the PCB and due to the change of direction of the primary fluid flow path 400 as it enters the body 30. The flow plate 700 is annular with a curved section 710 (FIGS. 3, 4*b*, 11*a*, 11*b*, 12*a* 12*b*, and 12*c*) that provides a smooth change in orientation or direction for the primary fluid flow path 400. By providing a curved surface 710 flow is directed around the corner reducing noise produced by the orthogonal change in direction and reducing any pressure loss or loss of velocity of the fluid. The entire flow plate 700 could be curved however, the benefits are seen by merely having the part of the flow plate 700 that is located in the lower half 390 of the body 30 having a curved surface 710.

The flow plate 700 is adjacent the PCB 75 and advantageously, the flow plate 700 is connected to the PCB 75 via a connecting bridge 720. The flow plate 700 is made from a conducting material preferably a metallic material such as aluminium or an alloy thereof so this bridge 720 provides a heat sink for the PCB 75 drawing heat from the components of the PCB and conducting that heat into the fluid flowing through the fluid flow path as it passes the flow plate 700.

In addition, the flow plate 700 serves as a thermal barrier for the PCB 75 and temperature sensitive components mounted thereon. A heater 80 is located within the body 30 downstream of the junction 90 between the body 30 and the handle 20 and the PCB 75 and when fluid is flowing through the primary fluid flow path 400 i.e. when the hairdryer is switched on the majority if not all of the heat produced by the heater 80 will be taken to the primary fluid outlet 440. However, when the hairdryer is turned off or onto stand-by, the heater will emit residual heat which will radiate both upstream and downstream so the flow plate ideally also acts as a thermal barrier for the PCB 75.

Figure 12A:
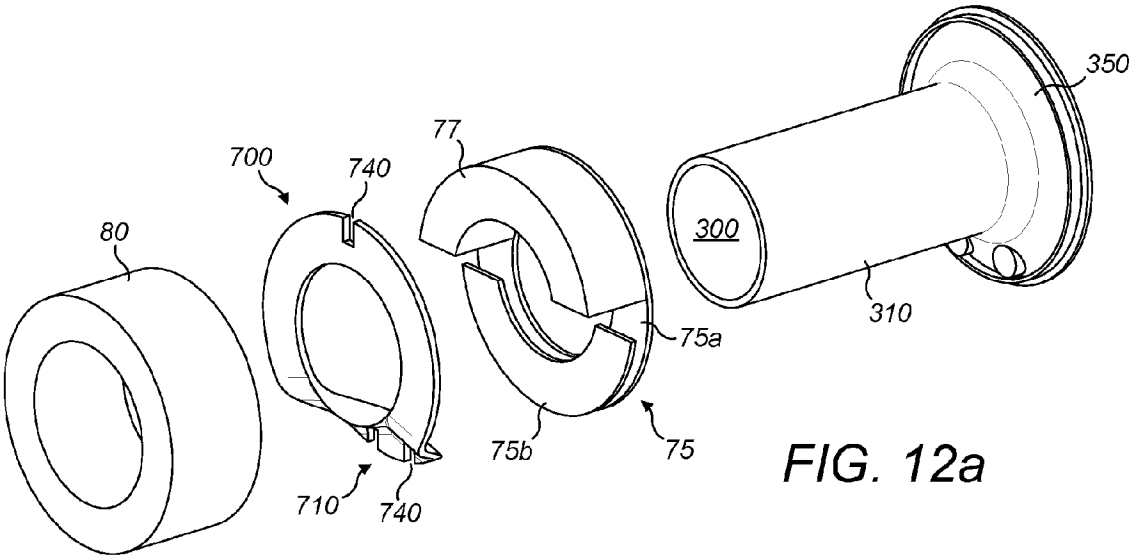
FIGS. 12*a*, 12*b* and 12*c* show views of various internal components of the body of a hairdryer according to an invention.
Figure 12B:
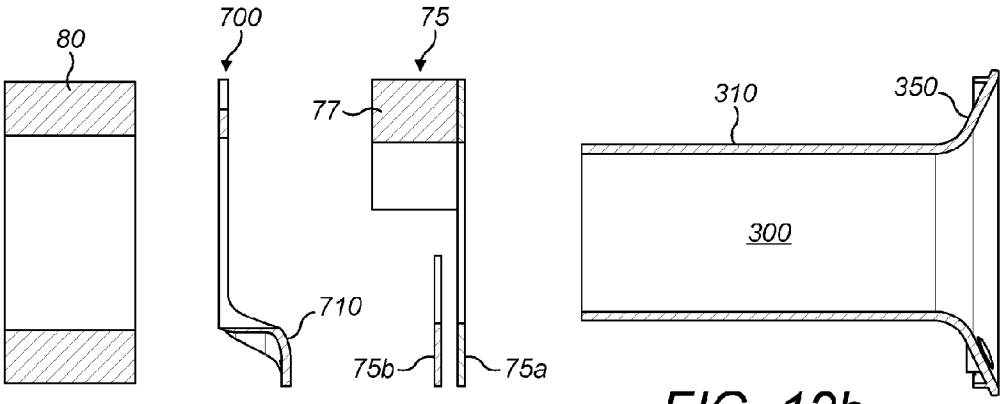
Figure 12C:
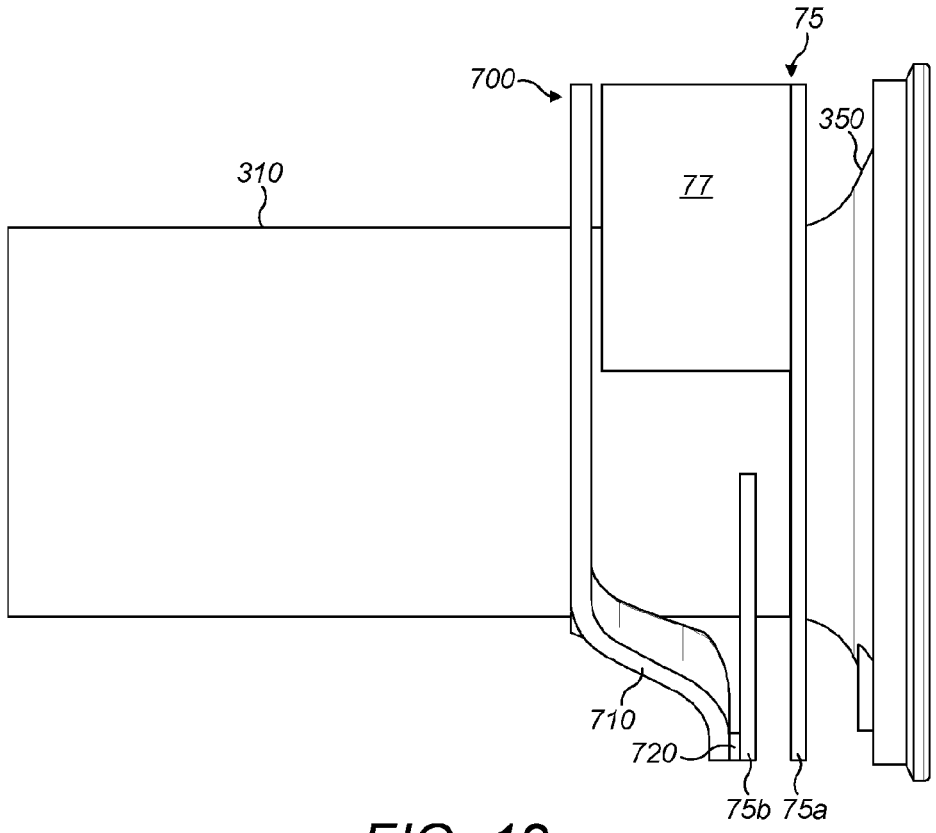

The flow plate 700 does not seal the PCB 75 against fluid in the fluid flow path 400 rather it enables fluid to flow around the PCB 75 either through openings 730 (FIG. 4*b* in particular) between the flow plate 700 and the body 30 or slots 740 within the flow plate (FIG. 12*a*).

The flow plate 700 has another function. In the event of a failure of one or more components such as a capacitor on the PCB 75, the flow plate 700 acts as a deflector plate which deflects any debris and/or electrolyte from a component failure back towards the side wall 350 and protects against the debris and/or electrolyte from entering the primary fluid flow path 400 where it would encounter the heater 80 and the primary fluid outlet 440.

FIGS. 13 to 16 show various views of a hairdryer 10 having an attachment 600 for changing a parameter of fluid output from the hairdryer. The attachment 600 comprises a bung 610 and an outer wall 660. Between the bung 610 and outer wall 660 an attachment fluid flow path 620 extends from an attachment fluid inlet 630 to an attachment fluid outlet 640. At the upstream end 660*a* of the outer wall 660 a ring of magnetic material 662 is provided. The ring of magnetic material 662 is recessed into or embedded in an upstream face 664 of the upstream end 660*a* of the outer wall 660.

Figure 3:
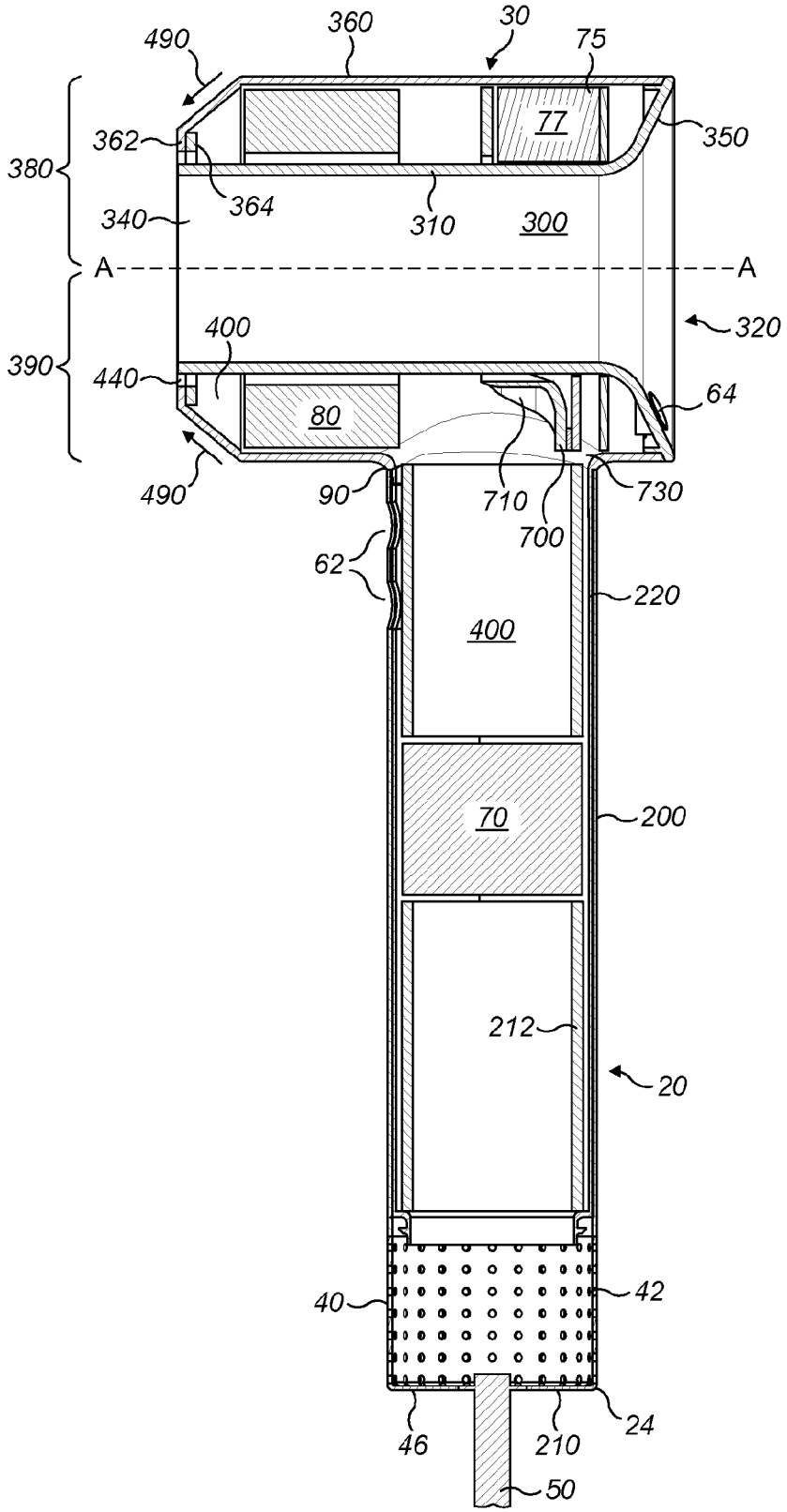
FIG. 3 shows a cross section though a hairdryer according to the invention.
Figure 4A:
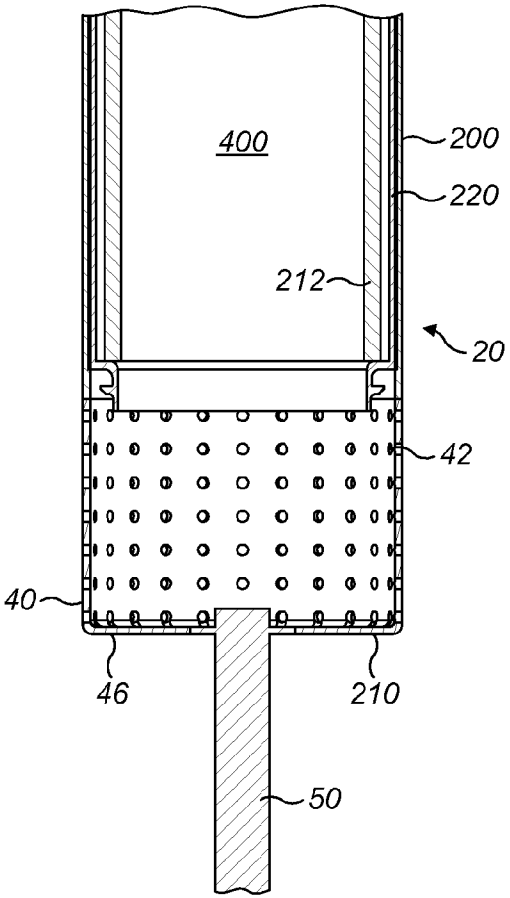

The hairdryer 10 includes a number of magnets 364 radially spaced around an end wall 362 at the second end 34 of the hairdryer 10 (FIGS. 3 and 4*a*). The end wall 362 extends radially inwards of the outer wall 360 of the body 30. These magnets 364 couple with the ring of magnetic material 662 when the attachment 600 is attached to the hairdryer 10.

Alternatively, the end wall 362 of the hairdryer 10 can include a ring of magnetic material and the attachment can include point magnets radially spaced around or another ring of magnetic material. Only one part of the magnetic connection needs to be magnetised, the other merely needs to be magnetically attracted to the magnetised part.

The use of a magnetic connection between the hairdryer and an attachment has a number of advantages, particularly when used with this type of hairdryer 10 i.e. one having an inner bore 300 defined by a duct 310 and components 77, 80 which extend around the bore. The spacing and maintaining the spacing between the duct 310 and the outer wall 360 of the hairdryer 10 along the length of the body 30 is important. If the duct 310 were pushed to one side within the body 30, the heater 80 could become damaged, fluid flow compromised and hot spots could appear on the outer wall 360. Thus, when an attachment is attached and removed, it is important not to introduce extra stress or strain on the hairdryer 10. Traditional push and snap fit and friction fit methods of attachment could do this. However, magnetic attachment provides consistent positioning at a known force. In addition if the product is dropped or knocked the magnetic force attracting the two parts can be set at a level which allows the attachment to snap off.

Figure 17A:
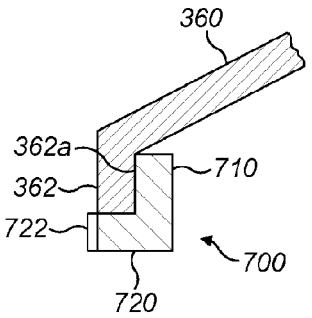
FIGS. 17*a* and 17*b* show alternative arrangements for magnetic attachment according to some embodiments.
Figure 17B:
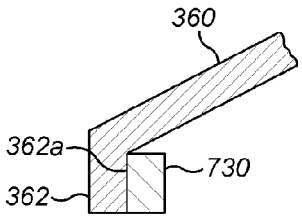

The force between the magnets can be manipulated in a number of ways. The use of discrete or point magnets is one way. A ring of magnetic material is an alternative. This could be a solid ring of a magnetic material such as iron or could comprise flakes of magnetic material moulded within a suitable substrate such as an epoxy resin. The ring of material can be fully exposed, partially exposed or concealed behind the end wall of the hairdryer. Referring now to FIGS. 17*a* and 17*b* two alternative constructions are discussed. Both options have the end wall 362 extending radially inwards of the outer wall 360 of the body. FIG. 17*a* shows an L-shaped ring of magnetic material 700 having a first leg 710 which engages the inner surface 362*a* of the front face 362 of the outer wall and a second leg 720 which extends from the first leg 710 towards the outer surface of the end wall 362. The second leg 720 may be flush with the outer surface. FIG. 17*b* shows an alternate construction where the ring of magnetic material 730 is positioned against the inner surface 362*a* of the end wall 362 and is completely concealed behind the end wall 362.

The ring of magnetic material 662 on the attachment 600 may also be fully exposed, partially concealed or fully concealed at the upstream face 664. When partially or fully exposed magnetic parts are used, both parts of the magnetic attachment 700, 662 are preferably flush with the respective end wall 362 and upstream face 664. Alternatively the two parts of the magnet are shaped to engage mechanically as well as magnetically. For example by the provision of one recessed magnet and one proud of the respective end wall and upstream face or a stepped surface to the magnets.

For the embodiments where the magnet is exposed, it is preferably covered in an anti scratch coating 722 (FIG. 17*a*) such as PTFE. This is advantageous as it allows for the attachment to be rotated with respect to the body of the appliance without damage to mating surfaces.

Figure 13:
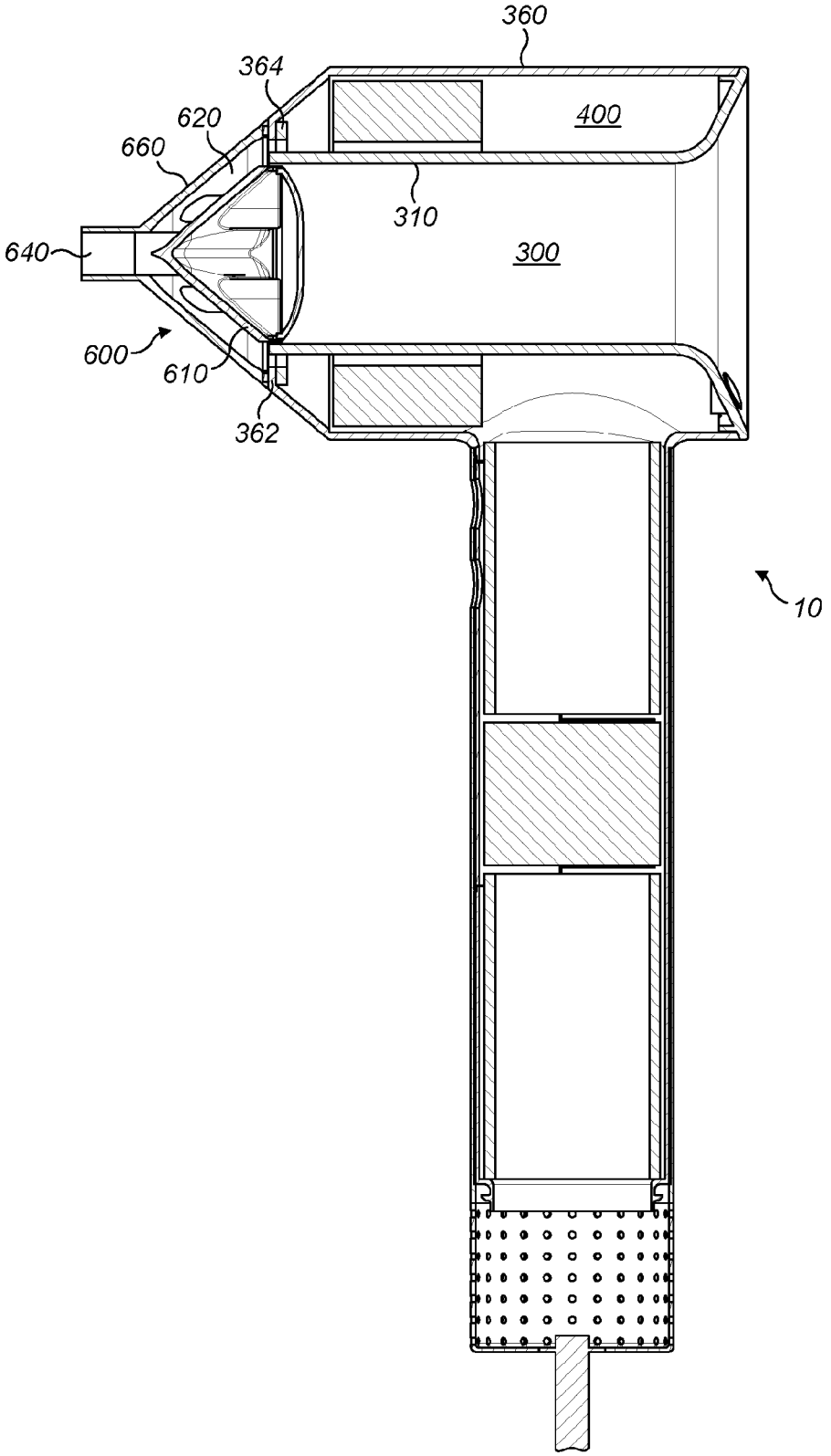
FIGS. 13 to 16 show various views of a hairdryer 10 having an attachment 600 for changing a parameter of fluid output from the hairdryer.
Figure 14A:
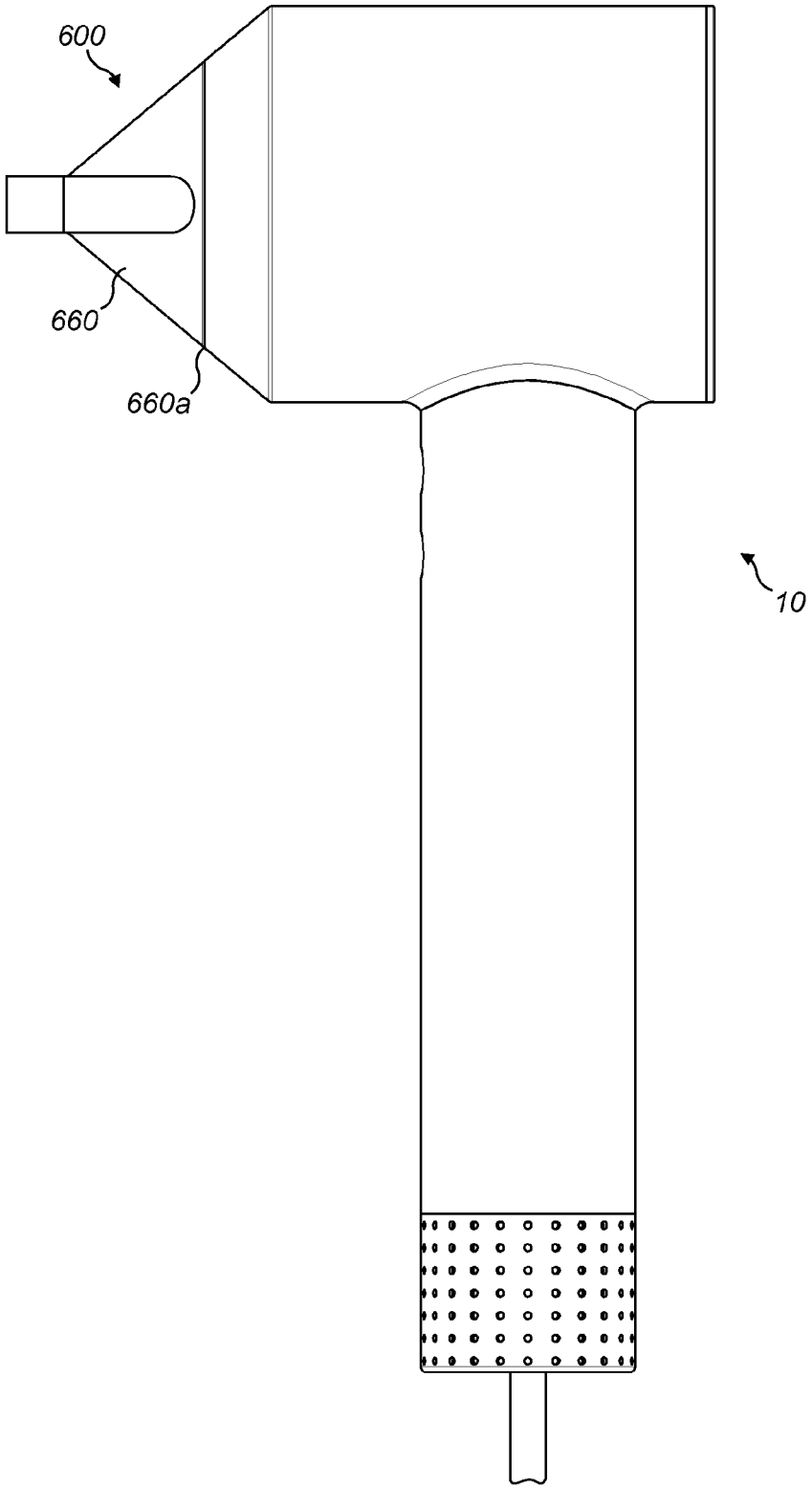
Figure 14B:
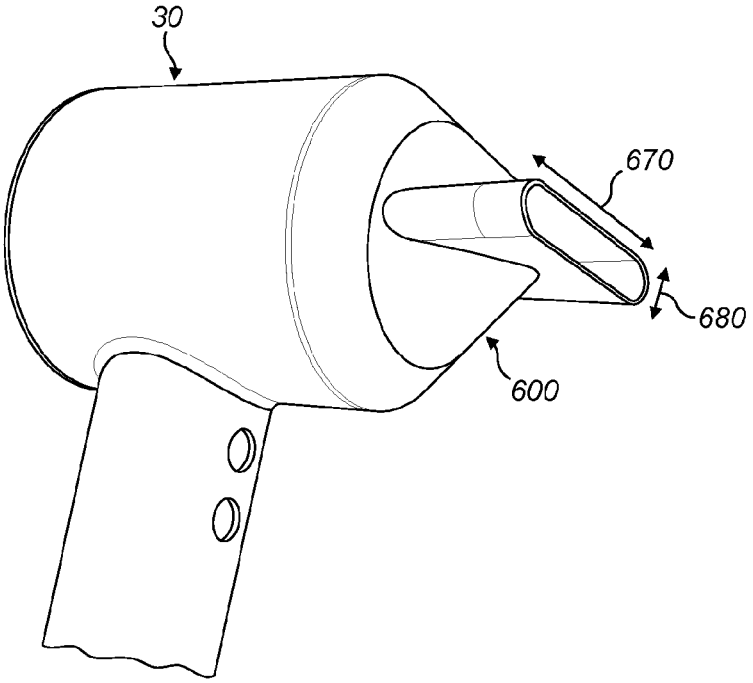
Figure 15:
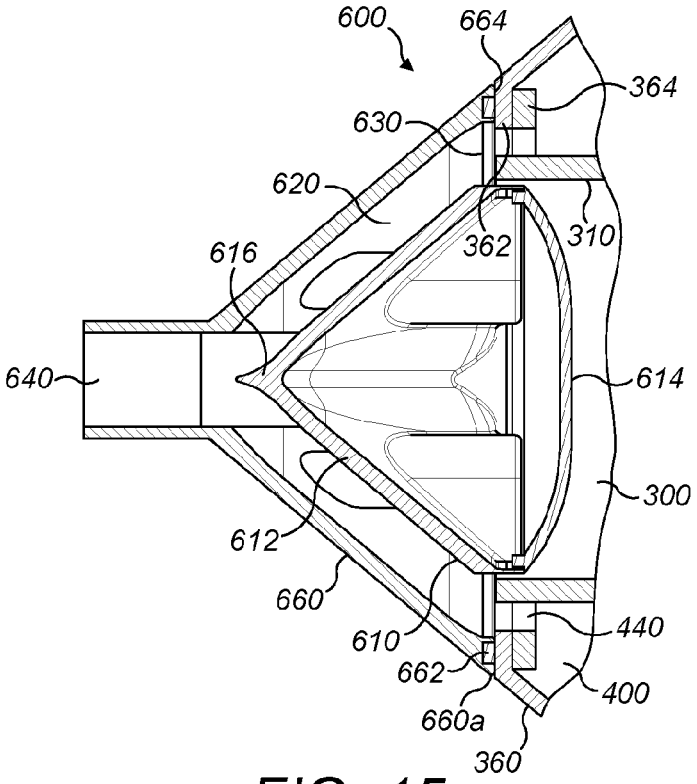
Figure 16:
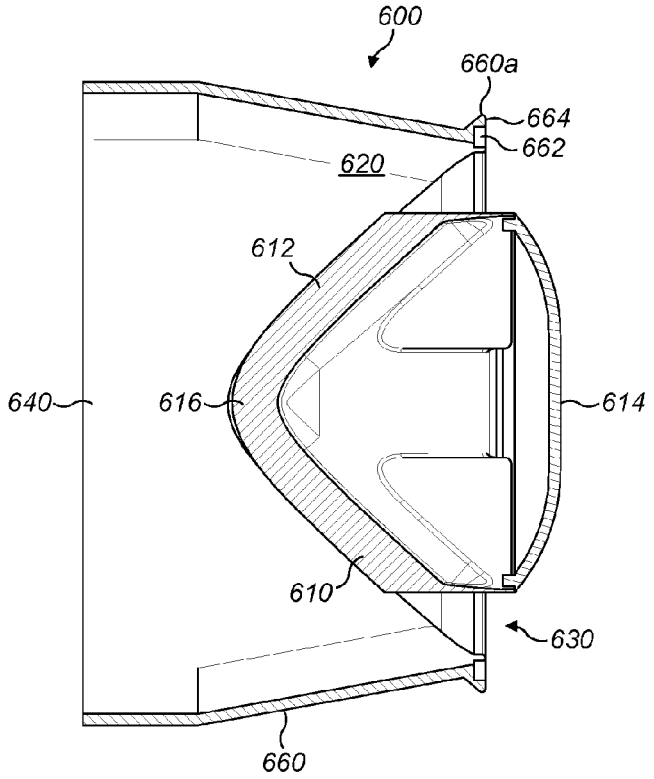

In the embodiments shown and referring to FIGS. 13, 14*a* and 14*b* in particular, the attachment 600 is a concentrator nozzle i.e. it concentrates the flow into a smaller area. The primary fluid flow path 400 of the hairdryer has an annular primary fluid outlet 440 and this provides a relatively large cross sectional area of heated fluid. The attachment 600 has an attachment fluid outlet 640 which is generally rectangular with its' long side 670 being similar to the diameter of the primary fluid outlet 440 (it may be bigger or smaller) and the short side 680 being significantly smaller than the diameter of the primary fluid outlet 440 and the long side 670. A concentrator nozzle 600 concentrates the flow over a smaller area providing a user with a directed flow. As the attachment 600 is rotatable with respect to the body 30 and can be positioned in any orientation with respect to the body 30, the flow from the attachment can be orientated horizontally or vertically or at any angle in between enabling the user to have fine control over drying.

Referring to FIGS. 13 to 16, when the attachment 600 is attached to a hairdryer 10, the outer wall 660 forms a continuation of the hairdryer outer wall 360. The bung 610 has two parts a cone 612 and a base 614. The cone 612 extends within the attachment 600 forming a point 616 towards the attachment fluid outlet 640 and directs flow from the primary fluid outlet 440 of the hairdryer towards the attachment fluid outlet 640. The cone 612 defines with the outer wall 660 the limits of the attachment fluid flow path 620. The base 614 is upstream of the cone 612 and limits flow from the fluid flow path 300 by extending into the end of the duct 310 forming a loose bung. The attachment fluid flow path 620 is in fluid communication with the primary fluid flow path 400 of the hairdryer 10 so fluid from the primary fluid flow path 400 is emitted from the attachment fluid outlet 640.

The invention has been described in detail with respect to a hairdryer and a hot styling brush however, it is applicable to any appliance that draws in a fluid and directs the outflow of that fluid from the appliance.

The appliance can be used with or without a heater; the action of the outflow of fluid at high velocity has a drying effect.

The attachment described has been a concentrating attachment however, magnetic attachment of any nozzle shape, size or with any function is possible.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hair care appliance comprising a body, and a handle having a first end in fluid communication with the body and a second end comprising a primary fluid inlet into the appliance wherein the primary fluid inlet comprises a first aperture extending at least partially around the handle and a second aperture extending through the second end of the handle, and wherein the handle comprises a first wall and a primary fluid flow path extends within the first wall and the handle comprises an outer wall that extends around the first wall and at least partially along the first wall.

2. The appliance of claim 1, wherein the handle comprises an end wall at the second end and the second aperture extends through the end wall.

3. The appliance of claim 2, wherein the end wall is substantially orthogonal to the handle.

4. The appliance of claim 1, wherein the first aperture is adjacent the second end of the handle.

5. The appliance of claim 1, wherein the handle includes a fan unit for drawing fluid into the primary fluid inlet.

6. The appliance of claim 5, wherein the fan unit is upstream of the primary fluid inlet.

7. The appliance of claim 1, wherein the first aperture comprises a plurality of apertures extending at least partially around the handle.

8. The appliance of claim 1, wherein the first aperture comprises a plurality of apertures extending at least partially along the handle.

9. The appliance of claim 8, wherein the plurality of apertures extend radially around the handle and along the outer wall of the handle from the second end.

10. The appliance of claim 1, comprising a power cable for supplying power to the fan unit is provided, the power cable extending through the second end of the handle.

11. The appliance of claim 10, wherein the power cable extends substantially centrally through the handle at the primary fluid inlet.

12. The appliance of claim 11, wherein the second aperture extends at least partially around the power cable.

13. The appliance of claim 1, wherein the primary fluid flow path extends from the primary fluid inlet through the handle and into the body to a primary fluid outlet.

14. The appliance of claim 1, wherein the inner wall of the handle is connected to the body at the first end.

15. The appliance of claim 1, wherein the handle comprises a layer of insulating material between the outer wall and the first wall.

16. The appliance of claim 13, wherein the primary fluid outlet comprises a plurality of apertures extending at least partially along and around the body.

17. The appliance of claim 1, wherein the primary fluid flow path is substantially linear through the handle and into the body.

18. The appliance of claim 1, wherein the handle is substantially orthogonal to the body.

19. The appliance of claim 1, wherein the body comprises a fluid flow path.

20. The appliance of claim 19, wherein the fluid flow path is defined by a duct extending through the body.

21. A hair care appliance comprising a body, and a handle having a first end in fluid communication with the body and a second end comprising a primary fluid inlet into the appliance wherein the primary fluid inlet comprises a first aperture extending at least partially around the handle and a second aperture extending through the second end of the handle, and wherein the body comprises a fluid flow path and the fluid flow path is defined by a duct extending through the body.

22. The appliance of claim 19, wherein the fluid flow path extends from a fluid inlet to a fluid outlet.

23. The appliance of claim 19, wherein the body comprises a heater for heating fluid in the primary fluid flow path.

24. The appliance of claim 23, wherein the heater extends around the duct.

25. The appliance of claim 23, wherein the heater extends along the body.

26. The appliance of claim 23, wherein the heater is annular.

27. The appliance of claim 19, wherein within the body the primary fluid flow path surrounds the fluid flow path.

28. The appliance of claim 27, wherein the primary fluid flow path merges with the fluid flow path within the body.

29. The appliance of claim 27, wherein a primary fluid outlet extends about the fluid flow path.

30. The appliance of claim 28, wherein a primary fluid outlet extends about a fluid outlet.

31. A hand held appliance comprising a body, and a handle having a first end in fluid communication with the body and a second end comprising a primary fluid inlet into the appliance, wherein the primary fluid inlet comprises a first aperture extending at least partially around the handle and a second aperture extending through the second end of the handle, and wherein the handle comprises a first wall and a primary fluid flow path extends within the first wall and the handle comprises an outer wall that extends around the first wall and at least partially along the first wall.

* * * * *